US009182702B2

(12) United States Patent
Wakimoto

(10) Patent No.: US 9,182,702 B2
(45) Date of Patent: Nov. 10, 2015

(54) TONER CASE FOR IMAGE FORMING APPARATUS

(71) Applicant: KYOCERA Document Solutions Inc., Osaka-shi, Osaka (JP)

(72) Inventor: Atsuhiro Wakimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/616,973

(22) Filed: Feb. 9, 2015

(65) Prior Publication Data

US 2015/0227079 A1 Aug. 13, 2015

(30) Foreign Application Priority Data

Feb. 12, 2014 (JP) ..... 2014-024476

(51) Int. Cl.
*G03G 15/08* (2006.01)
*G03G 21/18* (2006.01)

(52) U.S. Cl.
CPC .... *G03G 15/0865* (2013.01); *G03G 2215/0668* (2013.01); *G03G 2215/0673* (2013.01); *G03G 2215/0692* (2013.01)

(58) Field of Classification Search
CPC ..... G03G 15/0865; G03G 21/1676; G03G 21/1842; G03G 2215/066; G03G 2215/0668; G03G 2215/0673; G03G 2215/0692; G03G 2221/163
USPC ..... 399/258, 262, 119, 120, 13
See application file for complete search history.

(56) References Cited

U.S. PATENT DOCUMENTS

2004/0131391 A1* 7/2004 Nagashiro ..... 399/258
2011/0293294 A1* 12/2011 Eto ..... 399/13 X
2013/0243445 A1 9/2013 Takahira et al.
2014/0348544 A1* 11/2014 Morita ..... 399/258

FOREIGN PATENT DOCUMENTS

JP 2013190586 A 9/2013

* cited by examiner

*Primary Examiner* — Sophia S Chen
(74) *Attorney, Agent, or Firm* — Alleman Hall McCoy Russell & Tuttle LLP

(57) ABSTRACT

An image forming apparatus includes a toner container. The toner container includes an opening/closing portion and an operation portion. The image forming apparatus includes a drive transmission portion and a detection portion. When the lever of the operation portion is swingingly operated, the operation driving force of the operation is transmitted to the opening/closing portion via a first rotation portion and a second rotation portion. This allows a shutter cylinder to move from a closing position to an opening position. In addition, when the second rotation portion is rotated, a detected bar of the detection portion moves from a second position to a first position. The detection portion detects that a toner discharge outlet is opened, by detecting that the detected bar has moved to the first position.

7 Claims, 20 Drawing Sheets

TONER CASE FOR IMAGE FORMING APPARATUS

INCORPORATION BY REFERENCE

This application is based upon and claims the benefit of priority from the corresponding Japanese Patent Application No. 2014-024476 filed on Feb. 12, 2014, the entire contents of which are incorporated herein by reference.

BACKGROUND

The present disclosure relates to an image forming apparatus in which a toner case is attached to the apparatus main body, and specifically to an image forming apparatus that can detect an opening/closing state of the toner discharge outlet through which toner is supplied from the toner case to the apparatus main body.

There is known an image forming apparatus which is a copier, a printer or the like that forms an image on a print sheet based on the electrophotography. A developing device is installed in the image forming apparatus. Inside the developing device, developer including toner is stored. The developing device develops, with the toner included in the developer, an electrostatic latent image that has been formed on an image carrier such as a photoconductor drum. As developing is performed by the developing device, the toner inside the developing device is reduced. As a result, a toner case storing the toner is attached to the image forming apparatus such that the toner is supplied from the toner case to the developing device. The toner case is configured to be attachable/detachable with respect to the image forming apparatus. When the toner in the toner case is used up, the toner case is replaced with a new toner case filled with toner.

The toner case of this type has a toner discharge outlet through which toner is supplied to the developing device. The toner discharge outlet is configured to be opened and closed by an opening/closing mechanism that includes a shutter member or the like. Conventionally, there has been known an image forming apparatus that opens or closes the toner discharge outlet of the toner case in conjunction with an opening/closing operation of a cover member of the image forming apparatus, which exposes or closes an attachment portion to which the toner case is attached.

SUMMARY

An image forming apparatus according to an aspect of the present disclosure includes an apparatus main body and and a toner case configured to be attached to the apparatus main body. The toner case includes a housing, a toner discharge outlet, an opening/closing portion, and an operation portion. The housing is configured to store toner. The toner discharge outlet is formed in the housing. The opening/closing portion is provided in the housing and configured to open and close the toner discharge outlet. The operation portion is provided in the housing. The apparatus main body includes a drive transmission portion and a detection portion. The drive transmission portion includes: an input portion configured to receive a driving force input from the operation portion; and an output portion configured to output, to the opening/closing portion, the driving force transmitted from the input portion. The detection portion is configured to detect an opening/closing state of the toner discharge outlet. The operation portion includes a first coupling portion. The first coupling portion is configured to be coupled with the input portion of the drive transmission portion in a state where the toner case is attached to the apparatus main body, and transmit the driving force to the input portion. The opening/closing portion includes a second coupling portion and a displacement member. The second coupling portion is configured to be coupled with the output portion of the drive transmission portion in the state where the toner case is attached to the apparatus main body, and receive the driving force from the output portion. The displacement member is configured to be displaced, by the driving force transmitted to the second coupling portion, between an opening position for opening the toner discharge outlet and a closing position for closing the toner discharge outlet. The detection portion includes a detected member and a sensor. The detected member is configured to be moved upon receiving the driving force from the output portion of the drive transmission portion and displaced between a first position corresponding to the opening position of the displacement member and a second position corresponding to the closing position of the displacement member. The sensor is configured to detect at what position the detected member is.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
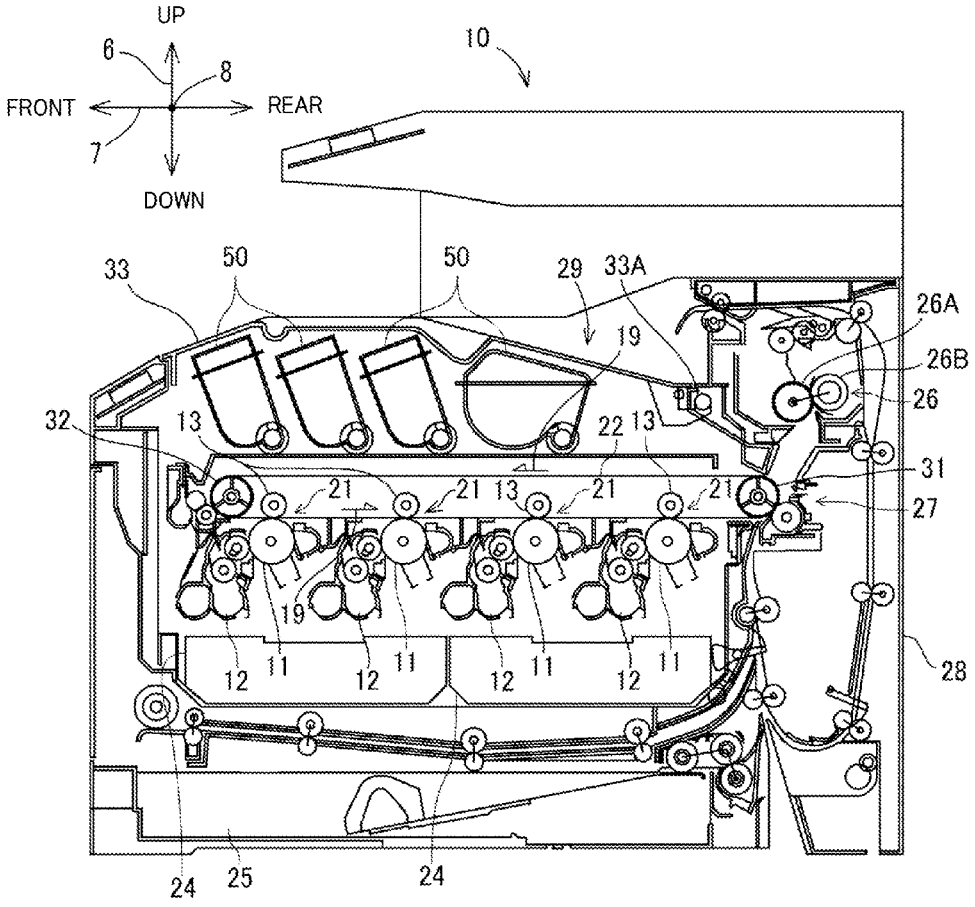
FIG. 1 is a diagram showing the configuration of an image forming apparatus according to an embodiment of the present disclosure.

The following describes an embodiment of the present disclusure with reference to the attached drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 in an embodiment of the present disclosure is installed on a flat surface. In addition, a front-rear direction 7 is defined on the supposition that the left side on the plane of FIG. 1 is the front side (front-surface side) of the image forming apparatus 10. Furthermore, a left-right direction 8 (a direction perpendicular to the plane of FIG. 1) is defined based on the image forming apparatus 10 of FIG. 1 viewed from the front side. Accordingly, the front side on the plane of FIG. 1 is the right side, and the depth side on the plane of FIG. 1 is the left side.

[Image Forming Apparatus 10]

The image forming apparatus 10 is an image forming apparatus that includes at least a print function. As shown in FIG. 1, the image forming apparatus 10 is a so-called tandem color printer. The image forming apparatus 10 prints an image on a sheet of print paper (recording medium) by using a developer that contains toner. It is noted that the image forming apparatus 10 may be any apparatus as far as it has the print function. For example, the image forming apparatus 10 may be a multifunction peripheral having a plurality of functions including the print function, or an image forming apparatus such as a FAX apparatus or a copier. Of course, the image forming apparatus 10 may be an apparatus for forming a monochrome image, instead of an apparatus for forming a color image.

As shown in FIG. 1, the image forming apparatus 10 includes, as major components, four image forming portions 21, an intermediate transfer belt 22, a sheet feed device 25, a fixing device 26, a secondary transfer device 27, an exposure device 24, and four toner containers 50 (50A-50D). These components are attached to an apparatus main body 28 (an example of the apparatus main body of the present disclosure) that is a housing constituting an external frame (not shown), an internal frame (not shown) and the like of the image forming apparatus 10. It is noted that the toner containers 50 are an example of the toner case for the image forming apparatus 10.

The four image forming portions 21 are provided aligned along the front-rear direction 7 in the apparatus main body 28. The image forming portions 21 are electrophotographic image forming portions that form toner images respectively on the photoconductor drums 11, and transfer the toner images to the intermediate transfer belt 22 that is moving in a direction indicated by the arrow 19, by overlaying the toner images onto the belt in sequence. In the example shown in FIG. 1, in order from the downstream side in the movement direction of the intermediate transfer belt 22 (the direction indicated by the arrow 19), the image forming portions 21 for black, yellow, cyan, and magenta are disposed in a row in the apparatus main body 28.

The image forming portions 21 execute an image forming process of forming an image on a print sheet based on the so-called electrophotography. The image forming portions 21 print an image on a print sheet based on the image data input from outside via a network communication portion (not shown). Each of the image forming portions 21 includes a photoconductor drum 11, a charging device (not shown), a developing device 12, a primary transfer device 13, and the like. The photoconductor drum 11 carries a toner image on its surface. The charging device charges the surface of the corresponding photoconductor drum 11 to a certain potential. The exposure device 24 scans the charged photoconductor drum 11 with laser light based on the image data. This allows an electrostatic latent image to be written on the surface of the photoconductor drum 11. The developing device 12 adheres toner to the electrostatic latent image on the photoconductor drum 11, thereby developing the electrostatic latent image with the toner. The primary transfer device 13 transfers the toner image from the rotating photoconductor drum 11 to the intermediate transfer belt 22. It is noted that although not shown in FIG. 1, each image forming portion 21 includes a cleaning device for removing toner that has remained on the photoconductor drum 11.

The intermediate transfer belt 22 is disposed above the image forming portions 21. The intermediate transfer belt 22 is a belt formed in the shape of an endless loop and made of rubber, urethane or other material. The intermediate transfer belt 22 is supported by a driving pulley 31 and a driven pulley 32 so as to be rotationally driven such that the belt surface extends horizontally in the front-rear direction 7. The driving pulley 31 is disposed in the rear (at the right side in FIG. 1) close to the fixing device 26, and the driven pulley 32 is disposed in the front (at the left side in FIG. 1) away from the fixing device 26. Supported by the driving pulley 31 and the driven pulley 32, the intermediate transfer belt 22 can move (run) in the direction indicated by the arrow 19, with its surface being in contact with the surfaces of the photoconductor drums 11. When the intermediate transfer belt 22 passes through between the photoconductor drums 11 and the primary transfer devices 13, the toner images are transferred in sequence from the photoconductor drums 11 to the intermediate transfer belt 22 and overlaid with each other on the surface thereof.

The secondary transfer device 27 is disposed in the rear of the apparatus main body 28. The secondary transfer device 27 transfers a color toner image formed from the toner images of the plurality of colors from the intermediate transfer belt 22 to a print sheet conveyed from a sheet feed tray of the sheet feed device 25. The print sheet with the color toner image transferred thereon is conveyed to the fixing device 26. The fixing device 26 fixes the color toner image on the print sheet, to the print sheet by heat. The fixing device 26 includes a heating roller 26A heated to a high temperature, and a pressure roller 26B disposed to face the heating roller 26A. In the fixing device 26, the print sheet is conveyed while being nipped by a predetermined biasing force at a nip portion between the heating roller 26A and the pressure roller 26B. This allows the color toner image to be fused and adhered to the print sheet. Subsequently, the print sheet is discharged onto a sheet discharge tray 29 provided on an upper part of the apparatus main body 28.

As described above, the image forming apparatus 10 forms a color toner image onto the intermediate transfer belt 22 by allowing the plurality of image forming portions 21 to transfer toner images of different colors onto the running intermediate transfer belt 22 such that the toner images are overlaid with each other on the surface of the belt. The color toner image is then transferred from the intermediate transfer belt 22 to a print sheet by the secondary transfer device 27. In this way, a color image is formed on the print sheet. It is noted that, as another embodiment, the intermediate transfer belt 22 may be used as a conveyance belt, and the toner images may be overlaid directly on a print sheet that is being conveyed on the conveyance belt. Also, as a still another embodiment, an intermediate transfer member in the shape of a roller may be used in place of the intermediate transfer belt 22.

The four toner containers 50 (50A-50D) are disposed above the intermediate transfer belt 22. Inside the apparatus main body 28, the four toner containers 50 are aligned in a row along the intermediate transfer belt 22 in the front-rear direction 7. The toner containers 50 are configured to supply toner to the developing devices 12 of corresponding colors.

Figure 2:
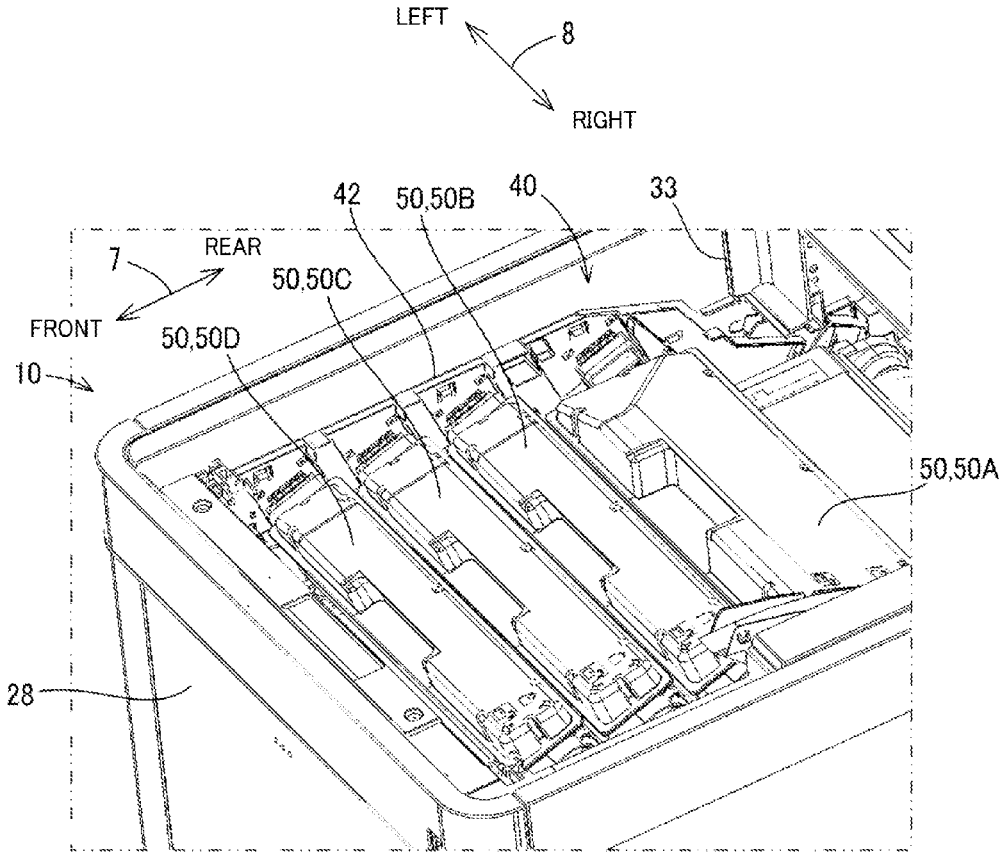
FIG. 2 is a perspective view showing the state where toner containers are attached in the image forming apparatus.

As shown in FIG. 2, an attachment portion 40 to which the toner containers 50 are attached is provided in the apparatus main body 28. In the present embodiment, as shown in FIG. 2, a top cover 33 (cover member) provided at the upper part of the apparatus main body 28 is supported by the apparatus main body 28 so as to be opened and closed by being rotationally moved around a spindle 33A (see FIG. 1). The spindle 33A is provided more in the rear than the four toner containers 50. When the top cover 33 is rotationally moved upward (in the opening direction), the attachment portion 40, to which the toner containers 50 are attached, is exposed. The attachment portion 40 has four housing spaces. When attached to the attachment portion 40, the four toner containers 50 are respectively held in the four housing spaces.

The toner containers 50 store toner of different colors that correspond to the colors of the image forming portions 21. Specifically, the toner containers 50 (50A-50D) store toner of black, yellow, cyan, and magenta, respectively. As shown in FIG. 2, among the four toner containers 50, the toner container 50A positioned on the most rear side is a large-capacity type and can store a larger amount of toner than the other toner containers 50B-50D. The toner container 50A stores black toner. The toner containers 50B-50D have the same shape and capacity. The toner container 50B stores yellow toner, the toner container 50C stores cyan toner, and the toner container 50D stores magenta toner. The toner container 50B is disposed in front of the toner container 50A, the toner container 50C is disposed in front of the toner container 50B, and the toner container 50D is disposed in front of the toner container 50C.

[Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner container 50A that is positioned on the most rear side among the toner containers 50A-50D is described as a toner container 50.

Figure 3:
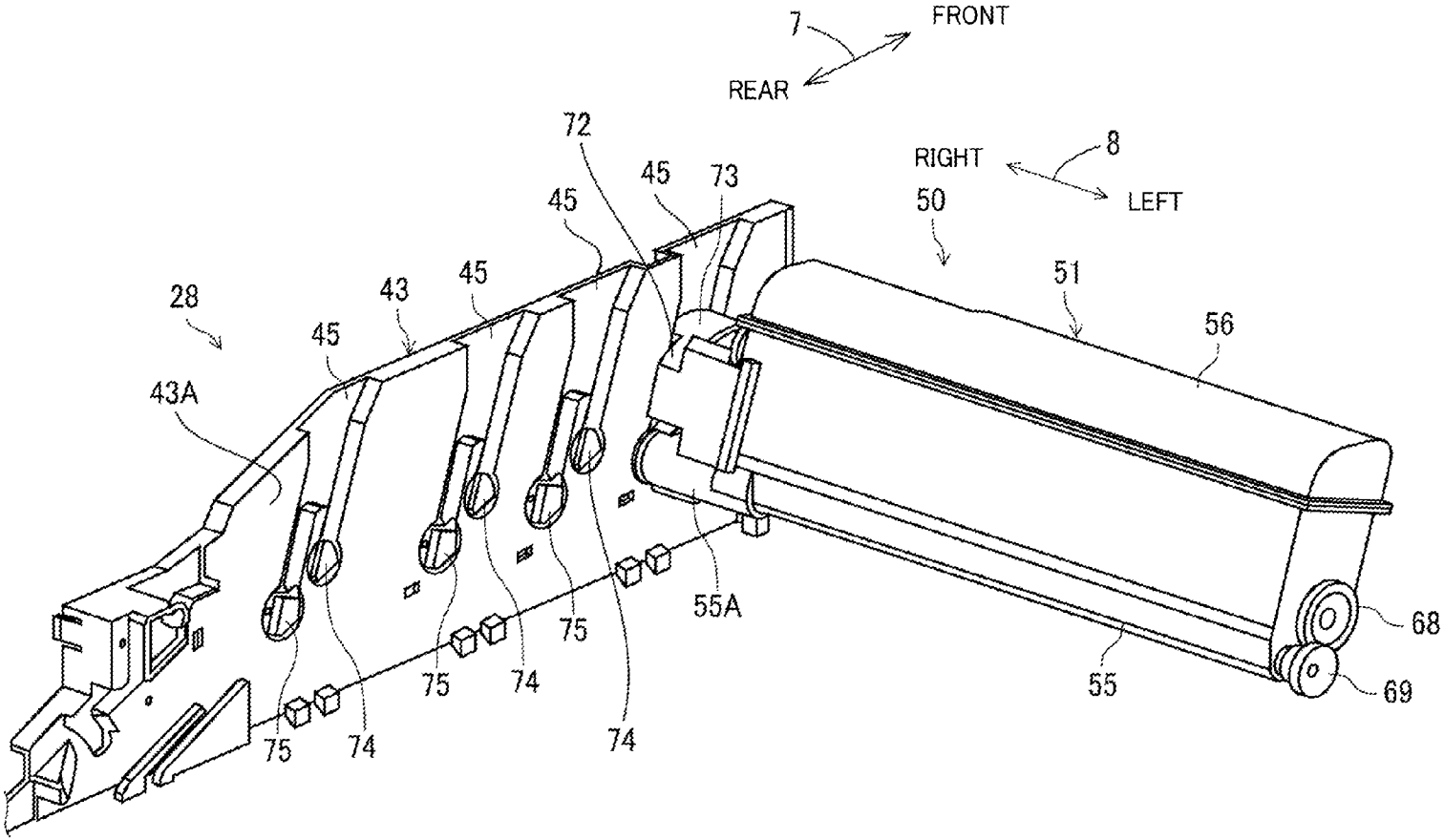
FIG. 3 is a perspective view showing a toner container and an attachment portion to which the toner container is attached.
Figure 4:
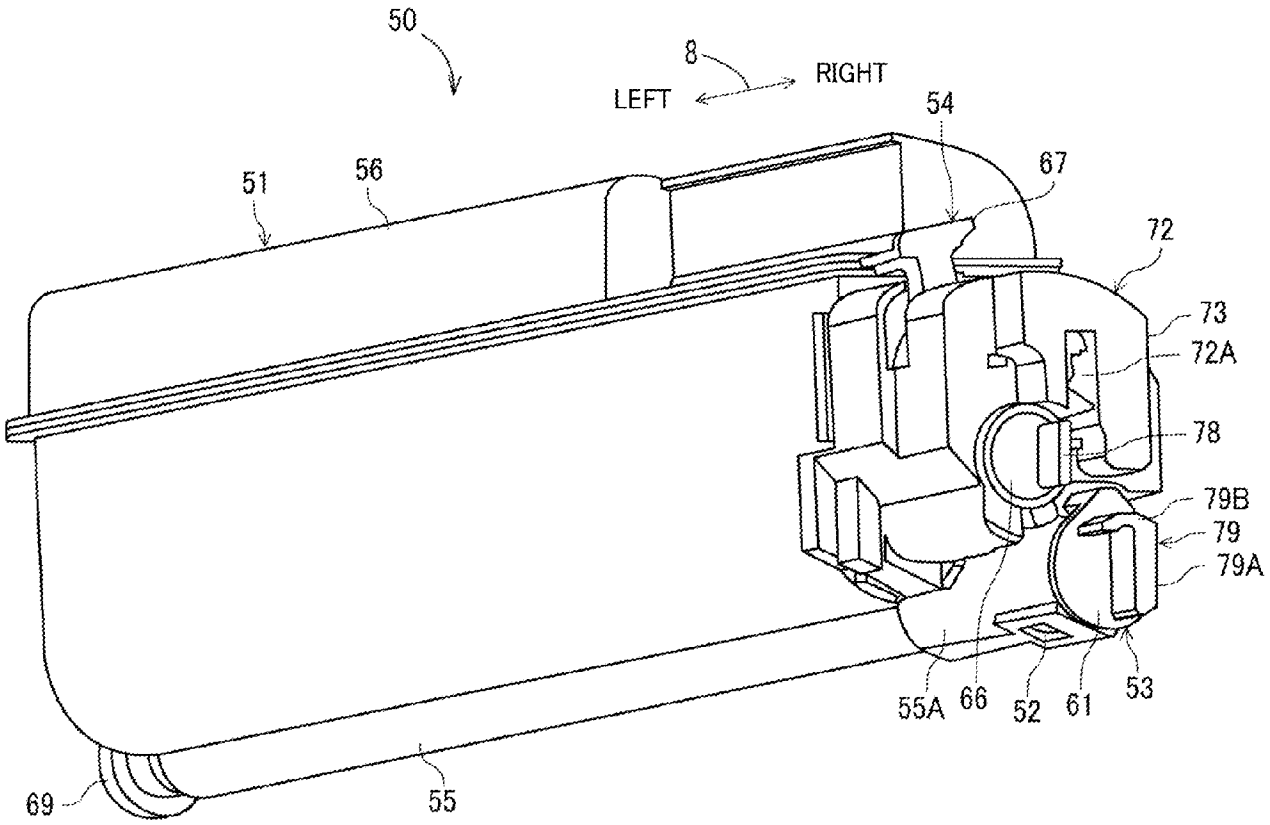
FIG. 4 is a perspective view showing an outer appearance of the toner container.
Figure 6:
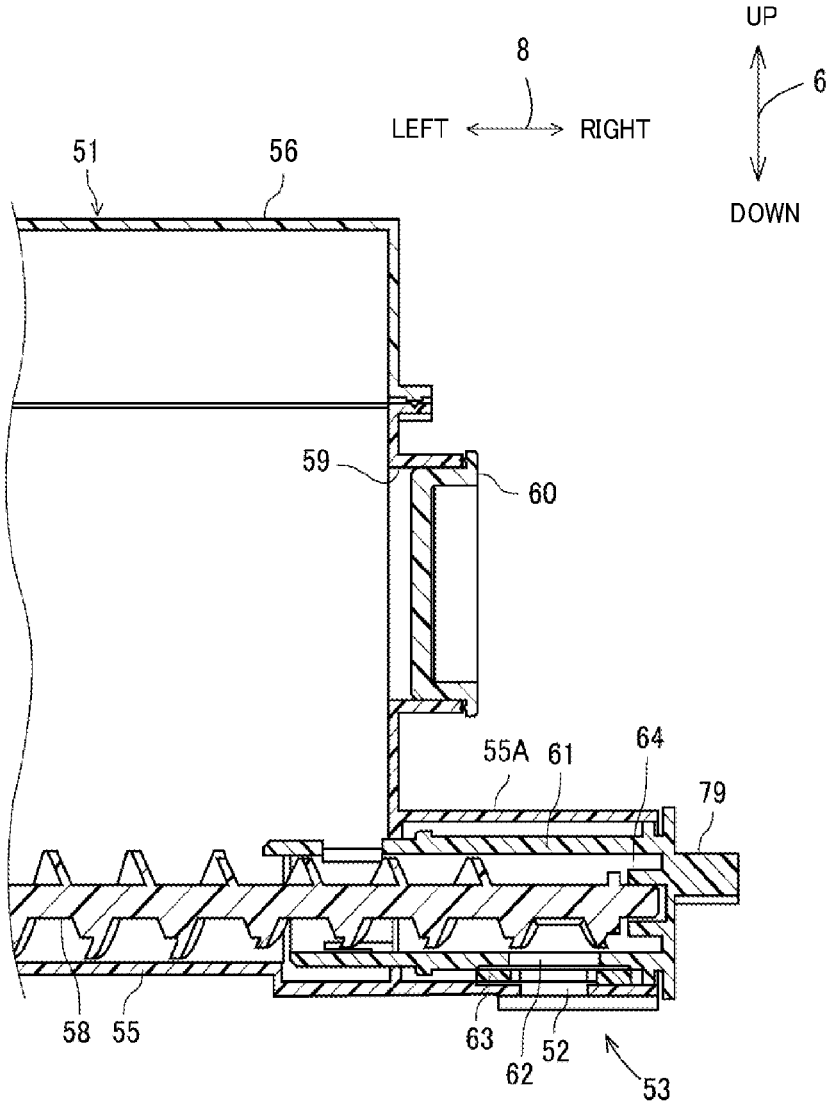
FIG. 6 is a cross section showing the configuration of the opening/closing portion.

The toner container 50 stores toner that is to be supplied to the developing device 12. As shown in FIGS. 3 and 4, the toner container 50 includes a housing 51, a toner discharge outlet 52 (see FIG. 6), an opening/closing portion 53, and an operation portion 54. The housing 51 stores toner and is attached to the apparatus main body 28 of the image forming apparatus 10. As shown in FIG. 6, the housing 51 has the toner discharge outlet 52. The toner discharge outlet 52 is formed in the bottom of the housing 51 at the right end thereof. In addition, as shown in FIG. 4, the operation portion 54 is provided on the housing 51 so as to be operated by the user.

As shown in FIGS. 2 and 3, the apparatus main body 28 includes support plates 42 and 43 so that the housing 51 can be attached thereto. The support plates 42 and 43 are plate-like and each extend in the front-rear direction 7. The support plates 42 and 43 are disposed to face each other in the attachment portion 40. As shown in FIG. 2, the support plate 42 is erected at the left end of the attachment portion 40, and as shown in FIG. 3, the support plate 43 is erected at the right end of the attachment portion 40. The support plates 42 and 43 support opposite ends of the four toner containers 50 respectively.

On a left side surface 43A (see FIG. 3) of one side (the left side) of the support plate 43, a plurality of container guides 45 extending diagonally upward are formed. The container guides 45 are grooves formed by partially hollowing the left side surface 43A of the support plate 43 in the thickness direction, each container guide 45 being formed to spread upward at the upper part of the support plate 43. The right end of the housing 51 is attached to the support plate 43 by being guided by the container guide 45 diagonally downward from the upper end of the support plate 43.

Figure 5:
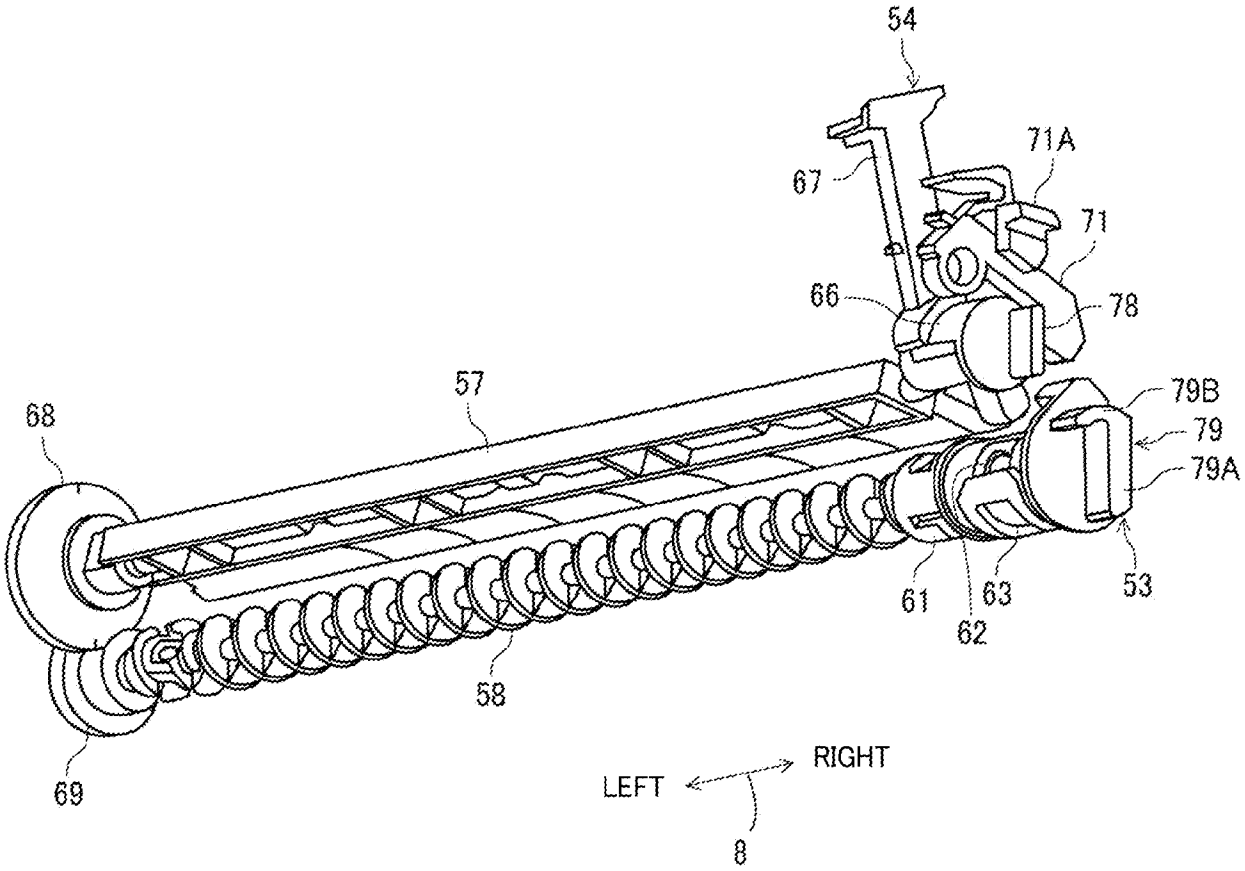
FIG. 5 is a perspective view showing an operation portion, an opening/closing portion, a stirring paddle, and a screw portion.

The housing 51 is made of a resin material, and is, as shown in FIG. 3, formed in the shape of a box that is long in the left-right direction 8. That is, the longitudinal direction of the housing 51 matches the left-right direction 8 of the image forming apparatus 10 shown in FIG. 1. It is noted that although a single toner container 50 is shown in FIGS. 4 through 6, the up-down direction 6, front-rear direction 7, and left-right direction 8 are defined with reference to the state where the toner container 50 is attached to the attachment portion 40.

As shown in FIG. 4, the housing 51 includes a container main body 55 and a lid 56. The container main body 55 is formed in the shape of a box which has a bottom and whose upper part is opened. The lid 56 closes the upper opening of the container main body 55. Inside the container main body 55, a stirring paddle 57 (see FIG. 5) and a screw portion 58 (see FIG. 5) are provided, wherein the stirring paddle 57 is configured to stir the toner, and the screw portion 58 is configured to convey the toner to the toner discharge outlet 52.

As shown in FIG. 6, a toner filling port 59 is provided on a right side wall of the container main body 55. The toner filling port 59 enables the toner to be filled into the housing 51. The toner filling port 59 is closed by a plug member 60.

As shown in FIGS. 4 and 6, the toner discharge outlet 52 is formed in the bottom of the container main body 55 at the right end thereof. Specifically, a protruding portion 55A is formed at the right end of the container main body 55, wherein the protruding portion 55A is in an approximate shape of cylinder protruding and extending rightward. The toner discharge outlet 52 is formed in such a way as to pass through the circumferential wall of the protruding portion 55A downward.

As shown in FIGS. 5 and 6, the opening/closing portion 53 includes a shutter cylinder 61 (displacement member), an opening 62, a seal member 63, and a second coupling portion 79. The shutter cylinder 61 is formed in the shape of a cylinder and inserted in the protruding portion 55A of the container main body 55. The right end of the shutter cylinder 61 is closed. In addition, the right end of the shutter cylinder 61 is integrally formed with the second coupling portion 79. As shown in FIG. 6, the opening 62 is formed on a side surface (lower surface) of the shutter cylinder 61. In addition, the seal member 63 is provided on a surface of the inner wall of the protruding portion 55A at a peripheral of the toner discharge outlet 52. The seal member 63 is provided for prevention of scattering of toner.

A bearing 64 (see FIG. 6) is formed inside the shutter cylinder 61 at the right end thereof. An end of the screw portion 58 is rotatably supported by the bearing 64.

The shutter cylinder 61 is attached so as to be rotatable with respect to the protruding portion 55A. When a rotational force is input to the second coupling portion 79, the shutter cylinder 61 is rotated. When, as the shutter cylinder 61 rotates, the opening 62 of the shutter cylinder 61 overlaps with the toner discharge outlet 52, the toner discharge outlet 52 is opened as shown in FIG. 6. Hereinafter, the position of the shutter cylinder 61 (the position shown in FIG. 6) that allows the toner discharge outlet 52 to be opened is referred to as an "opening position". When the shutter cylinder 61 is at the opening position, toner in the housing 51 is discharged from the toner discharge outlet 52 to the developing device 12. On the other hand, when the shutter cylinder 61 is rotated to a position where the circumferential wall of the shutter cylinder 61 except for the opening 62 overlaps with the toner discharge outlet 52, the toner discharge outlet 52 is closed. Hereinafter, the position of the shutter cylinder 61 (the position shown in FIG. 9) where the toner discharge outlet 52 is closed is referred to as a "closing position". In this way, with the rotation of the second coupling portion 79, the shutter cylinder 61 is displaced between the opening position for opening the toner discharge outlet 52 and the closing position for closing the toner discharge outlet 52. That is, the toner discharge outlet 52 is opened and closed with the rotation of the shutter cylinder 61. It is noted that the second coupling portion 79 is described in detail below.

As shown in FIGS. 4 through 9, the operation portion 54 is provided at the right end of the container main body 55. It is noted that the operation portion 54 is omitted in FIG. 6. The operation portion 54 includes a shaft 66 and a lever 67. The shaft 66 is rotatably supported by the container main body 55. The lever 67 is attached to the shaft 66 and fixed thereto.

The shaft 66 includes a shaft core that extends in the left-right direction 8. The lever 67 is configured to be swung around the shaft core of the shaft 66 integrally with the shaft 66. As shown in FIG. 5, the right end of the stirring paddle 57 is supported so as to be rotatatble inside the shaft 66. On the other hand, the left end of the stirring paddle 57 is coupled with a stirring gear 68, and the left end of the screw portion 58 is coupled with a driving gear 69. As shown in FIG. 3, the stirring gear 68 and the driving gear 69 are disposed at the left end of the container main body 55.

A lock member 71 is provided at the right end of the container main body 55. The lock member 71 locks the operation portion 54 and the opening/closing portion 53 for the purpose of preventing mulfunctioning. That is, the lock member 71 locks the operation portion 54 in such a way as to restrict the operation of the operation portion 54. Furthermore, the lock member 71 locks the opening/closing portion 53 in such a way as to restrict the opening/closing operation of the opening/closing portion 53. A claw 71A projecting rightward is integrally formed with the lock member 71.

Figure 9:
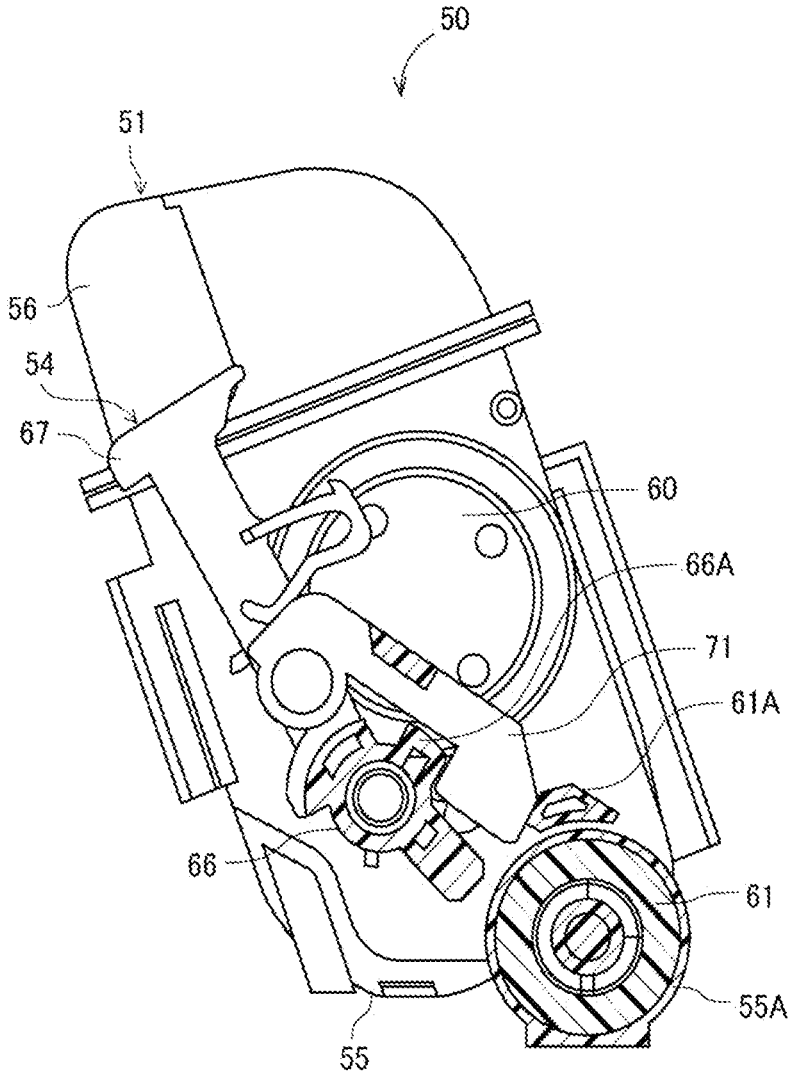
FIG. 9 is a partially broken view of the toner container.

As shown in FIG. 9, when the operation portion 54 and the opening/closing portion 53 are in the lock state, the lower part of the lock member 71 is clamped by a projection 66A that is integrally formed with the shaft 66 and a projection 61A that is integrally formed with the shutter cylinder 61. With this configuration, the lock member 71 does not allow the shaft 66 to rotate clockwise in FIG. 9, and does not allow the shutter cylinder 61 to rotate counterclockwise in FIG. 9. That is, the lock member 71 restricts the shaft 66 from rotating clockwise, and restricts the shutter cylinder 61 from rotating counterclockwise. It is noted that the lock member 71 is configured to release the lock state of the operation portion 54 and the opening/closing portion 53 by being slided upward in FIG. 9.

Figure 7:
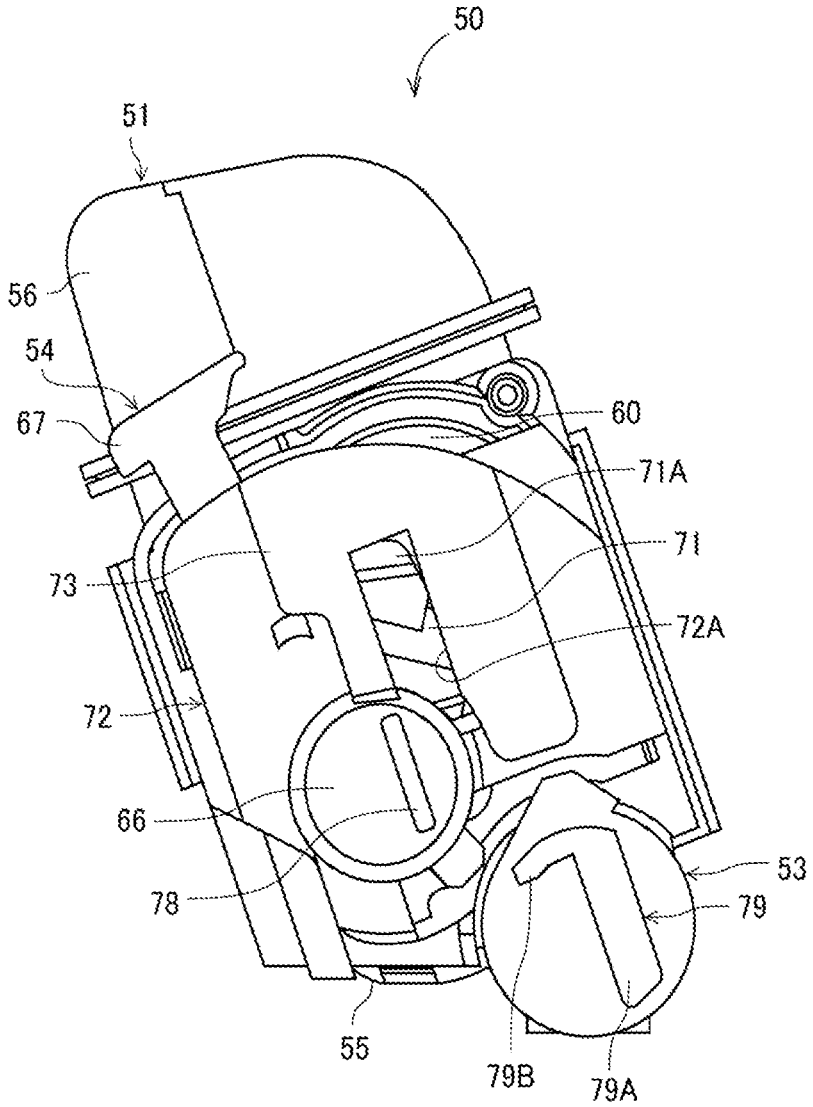
FIG. 7 is a side view showing the configuration of a side surface of the toner container.

As shown in FIGS. 4 and 7, a cover member 72 is provided at the right end of the container main body 55. The cover member 72 is attached in such a way as to cover the base part of the lever 67 and the lock member 71. The cover member 72 includes a positioning protrusion 73 that appears like a block protruding rightward from the right end of the container main body 55. A slit 72A extending in the up-down direction and opened downward is formed in the cover member 72. The slit 72A is formed at a position where the positioning protrusion 73 is divided into two parts along the front-rear direction 7. Thus with the presence of the slit 72A, the lower part of the cover member 72 is branched into two parts. Furthermore, as shown in FIG. 7, the claw 71A of the lock member 71 is exposed through the slit 72A of the cover member 72.

The width of positioning protrusion 73 is determined such that the positioning protrusion 73 can be fitted into a container guide 45 (see FIG. 3), and is slightly smaller than the groove width of the container guide 45. This enables the positioning protrusion 73 to be attached to the container guide 45. Specifically, as shown in FIG. 3, the positioning protrusion 73 is formed to such a size as to be fitted into the container guide 45 and guided diagonally downward by the container guide 45, thereby the housing 51 is attached to a support plate 43.

Figure 10:
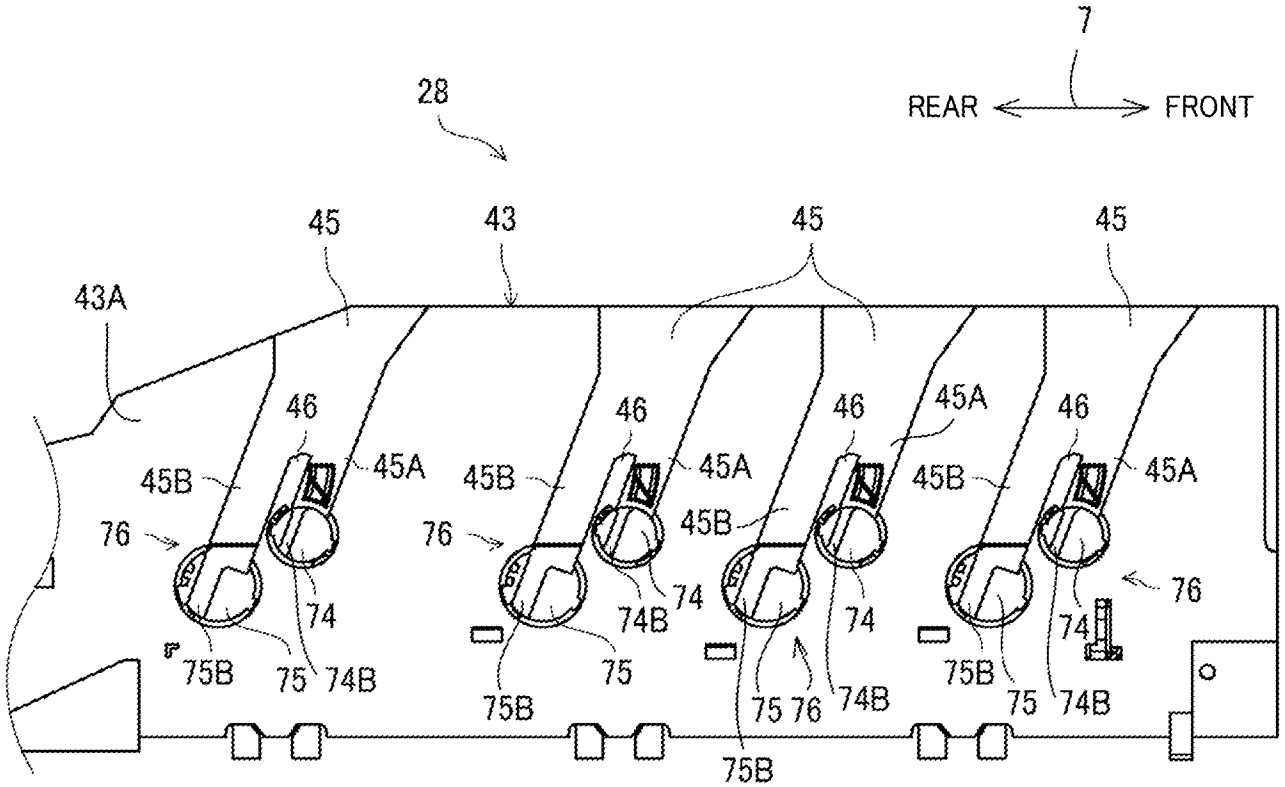
FIG. 10 is a diagram showing the configuration of a support plate of the attachment portion.
Figure 11:
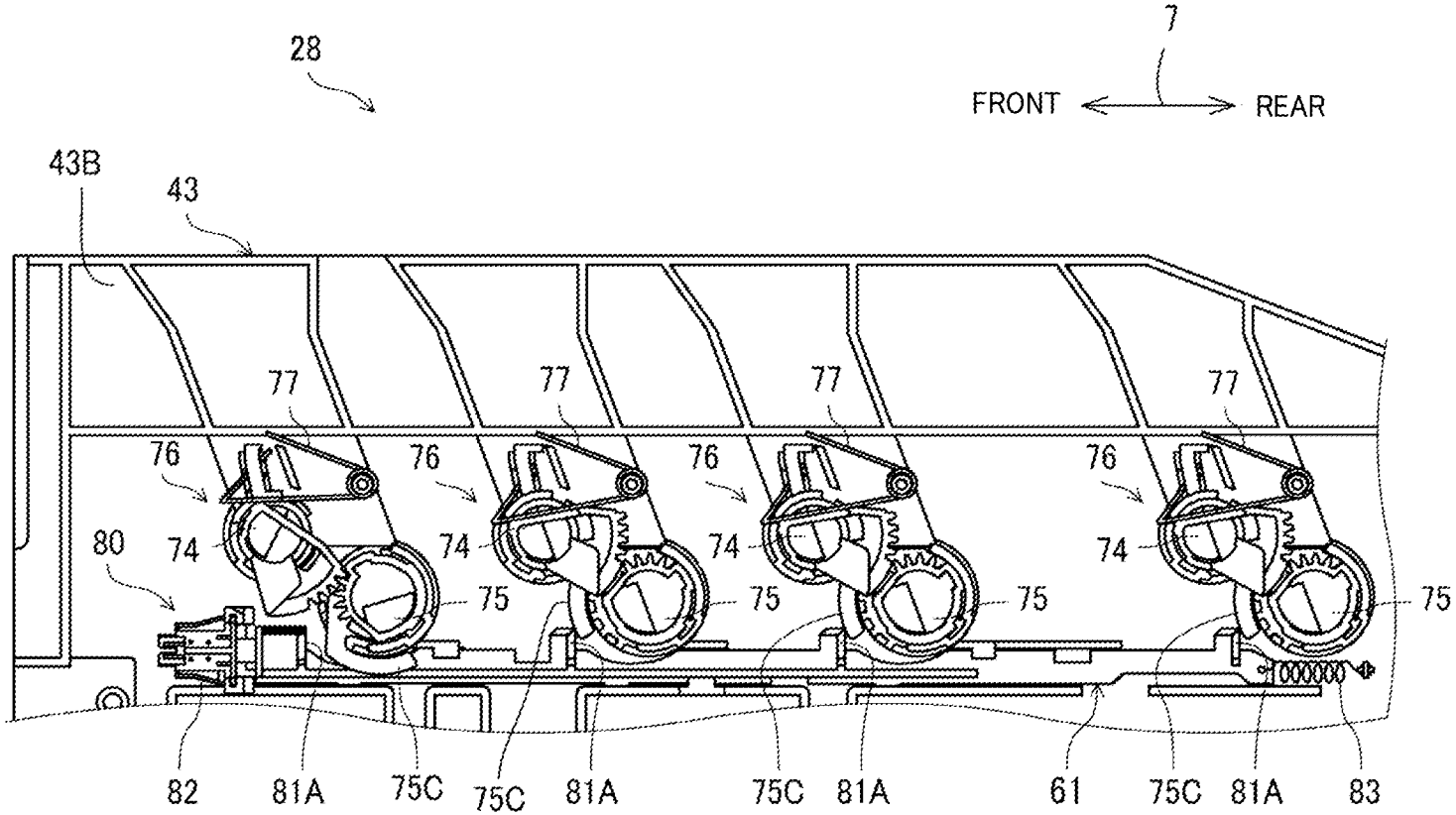
FIG. 11 is a diagram showing the support plate to which a toner container is attached.
Figure 12:
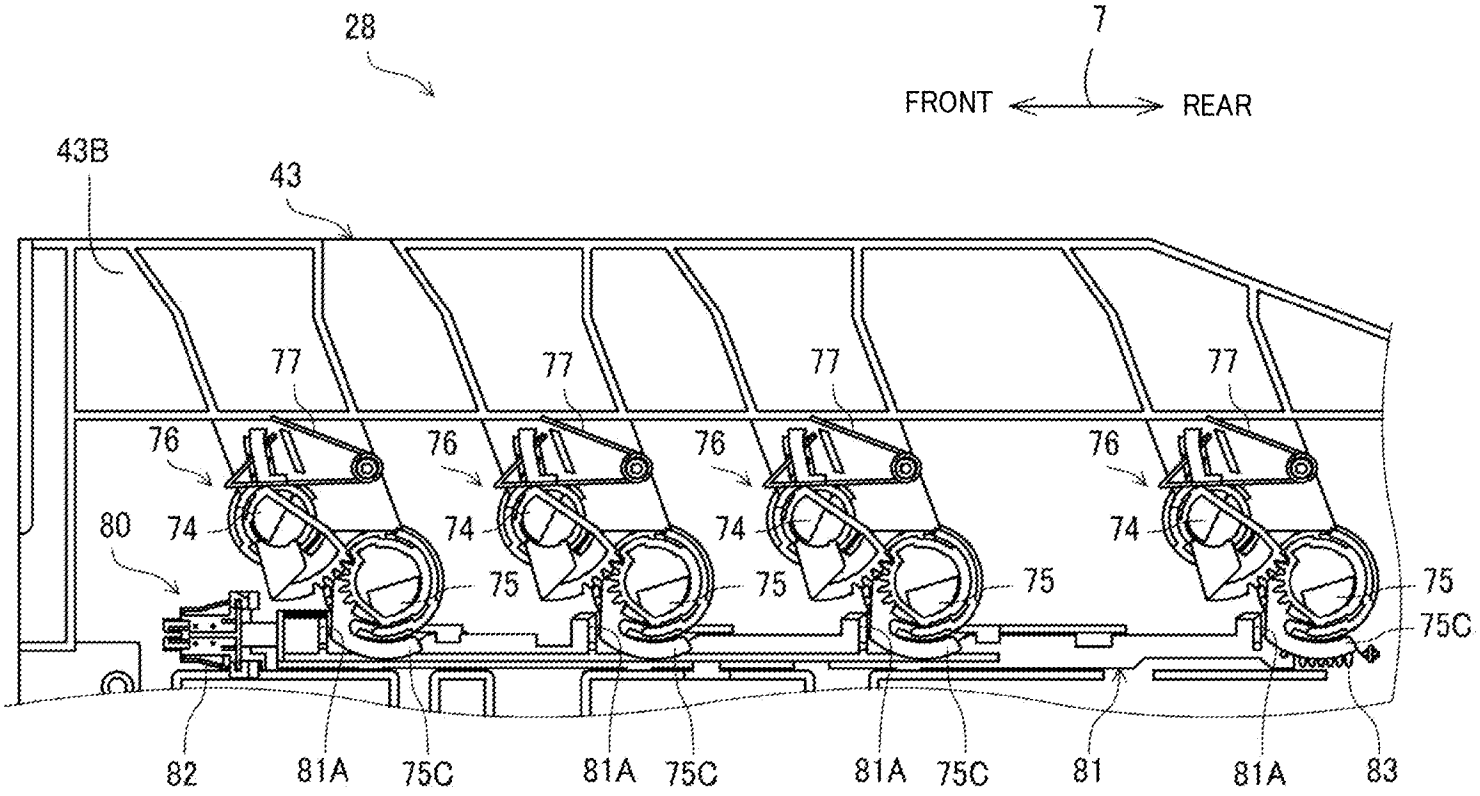
FIG. 12 is a diagram showing the support plate to which four toner containers are attached.
Figure 13:
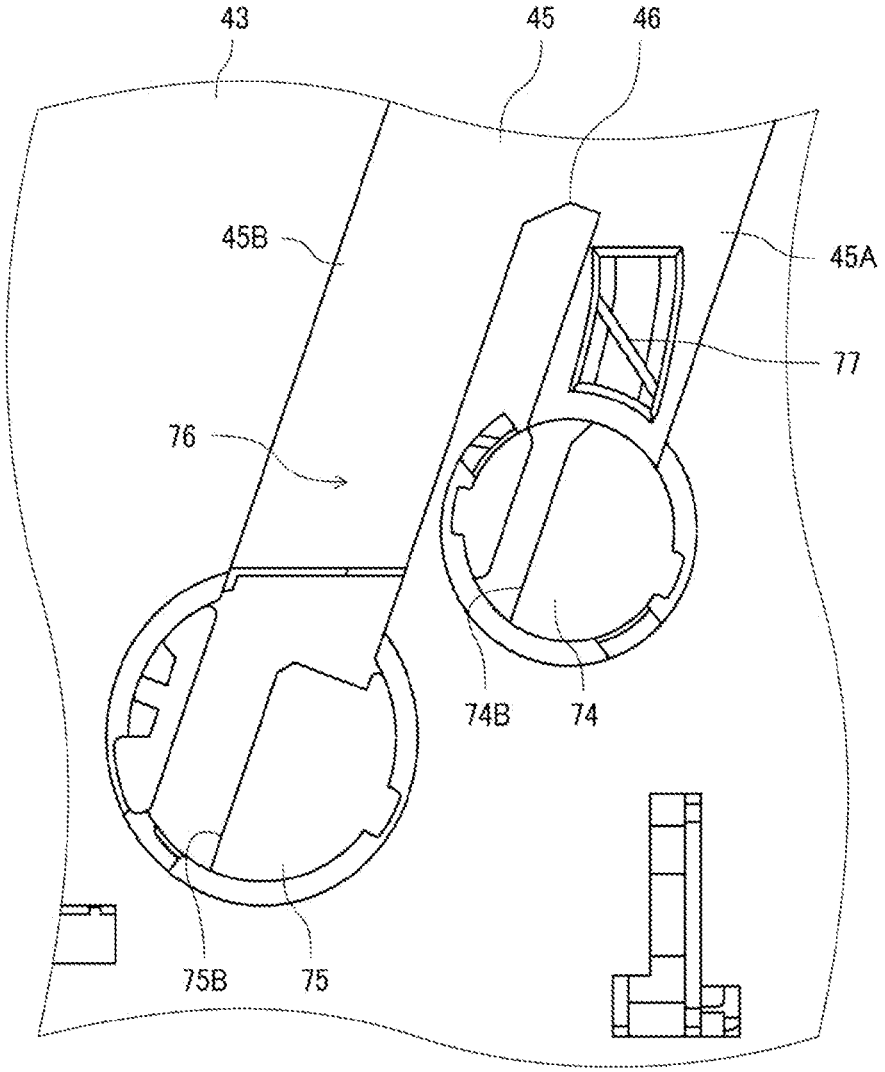
FIG. 13 is an enlarged view of a drive transmission portion.
Figure 14:
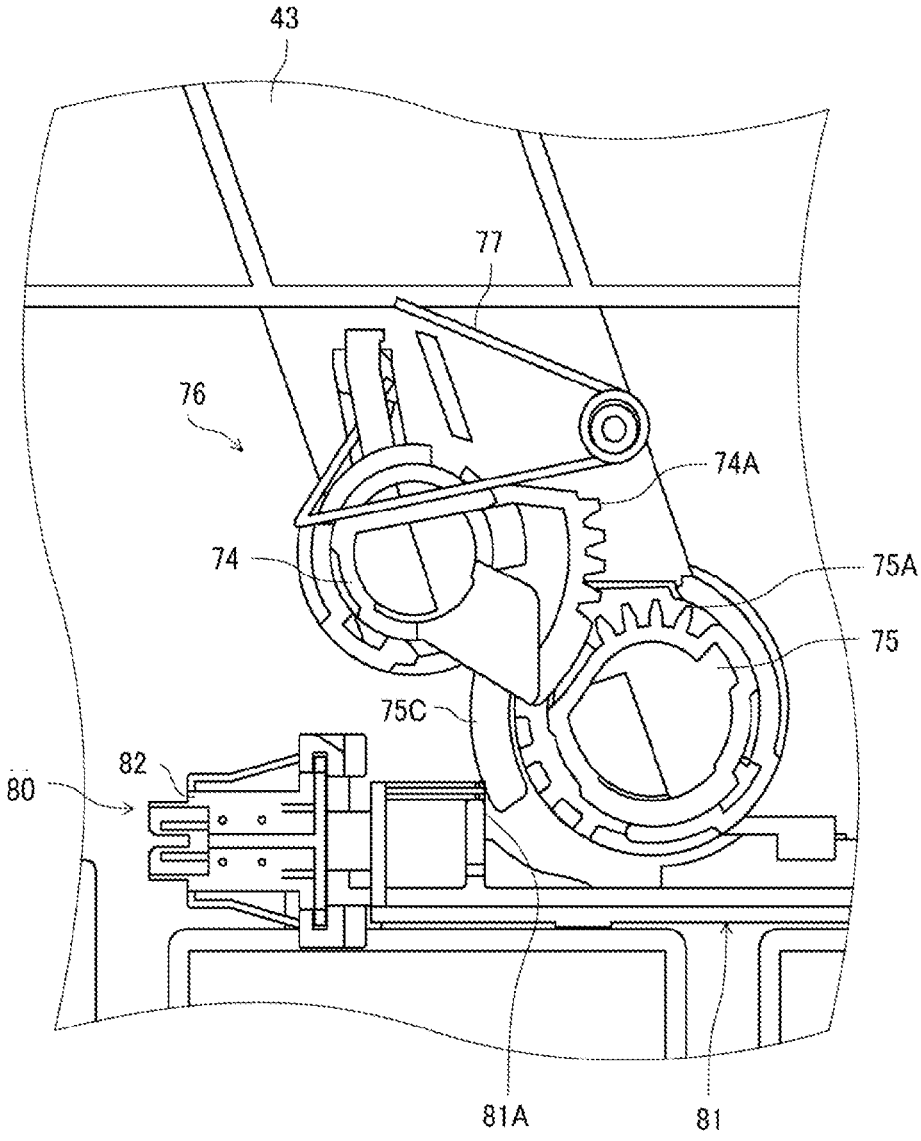
FIG. 14 is an enlarged view of the drive transmission portion.
Figure 15:
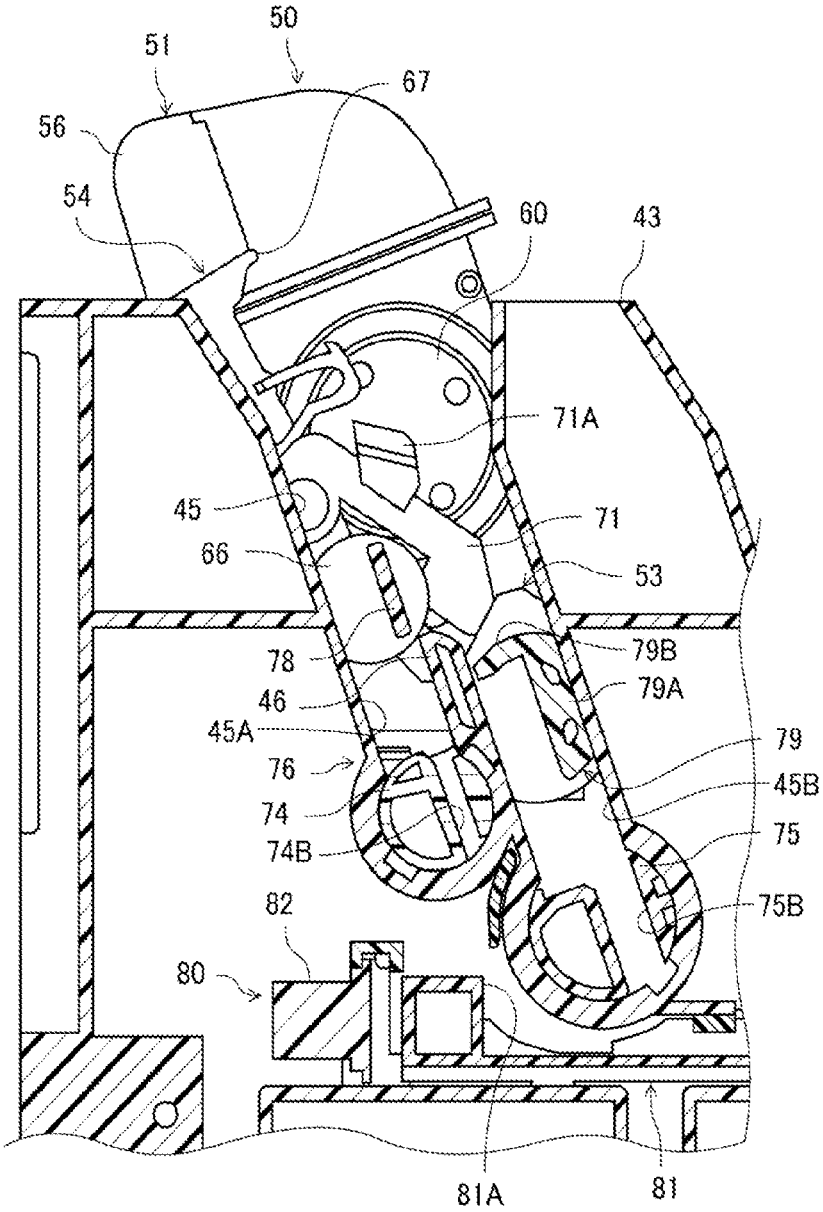
FIG. 15 is a partially broken view of the toner container that is being attached to the support plate.
Figure 16:
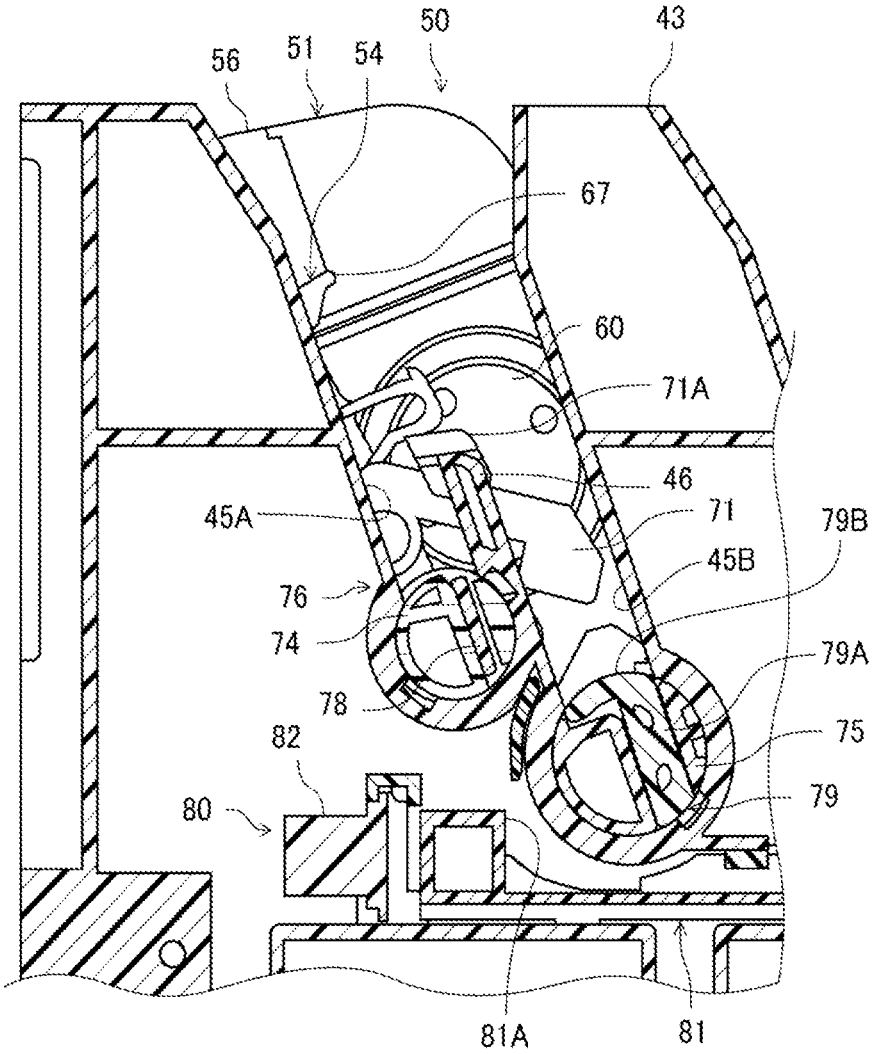
FIG. 16 is a partially broken view of the toner container attached to the support plate, with the lock state of the lock member released.
Figure 17:
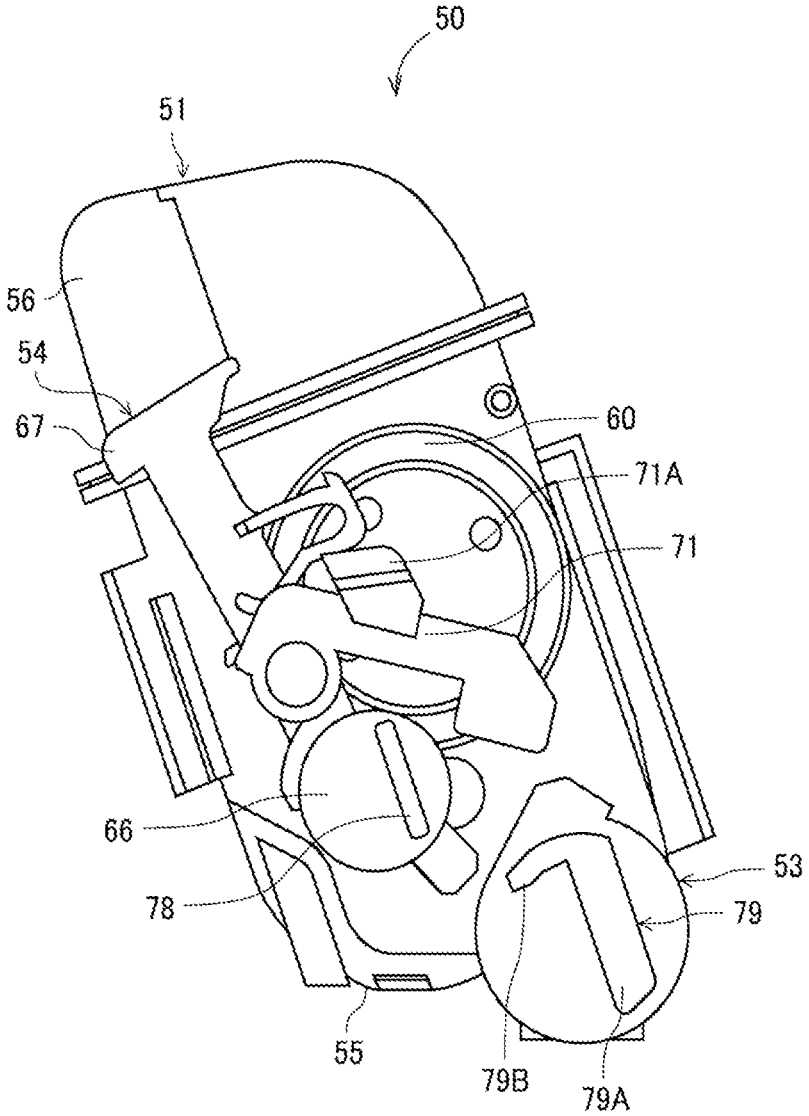
FIG. 17 is a side view of the toner container, with the lock state of the lock member released.

Here, FIGS. 10 through 12 show outer appearances of the support plate 43. FIGS. 13 and 14 are enlarged views of a drive transmission portion 76. FIGS. 15 through 17 show how the lock member 71 is operated to release the lock state of the operation portion 54 and the opening/closing portion 53. It is noted that FIG. 10 shows the support plate 43 viewed from the left side surface 43A, and FIG. 13 is an enlarged view of a peripheral of one of the container guides 45 shown in FIG. 10. In addition, FIGS. 11 and 12 show the support plate 43 viewed from a right side surface 43B, showing that the drive transmission portions 76 are provided on the right side surface 43B of the support plate 43. FIG.14 is an enlarged view of a peripheral of one of the drive transmission portions 76 shown in FIGS. 11 and 12. It is noted that the cover member 72 is omitted in FIGS. 15 through 17 for the sake of explanation.

As shown in FIGS. 10 through 13, the lower part of each container guide 45 on the support plate 43 is branched into a first groove 45A and a second groove 45B such that the lower two parts of the cover member 72 are attached thereto. Between the first groove 45A and the second groove 45B, a projection 46 is formed to extend along the first groove 45A and the second groove 45B.

When the cover member 72 is guided diagonally downward as the attachment direction by the container guide 45, the projection 46 is inserted into the slit 72A of the cover member 72. Subsequently, as shown in FIGS. 15 through 17, the upper part of the projection 46 abuts on the claw 71A of the lock member 71, and pushes up the lock member 71. In this way, when the toner container 50 is attached to the support plate 43, the lock member 71 is configured to abut on the projection 46 in such a way as to release the lock state of the operation portion 54 and the opening/closing portion 53 by the lock member 71.

As shown in FIGS. 10 throughl4, the apparatus main body 28 is provided with the drive transmission portions 76. The drive transmission portions 76 are provided on the support plate 43. In the present embodiment, four drive transmission portions 76 are provided in correspondence with the four toner containers 50. The drive transmission portions 76 are provided in alignment in the front-rear direction 7 on the right side surface 43B of the support plate 43.

When an operation driving force (driving force) is input from the operation portion 54 in the state where the toner container 50 is attached to the support plate 43, the drive transmission portion 76 transmits the operation driving force to the opening/closing portion 53. Each drive transmission portion 76 includes a first rotation portion 74 (input portion) and a second rotation portion 75 (output portion). The first rotation portion 74 receives the operation driving force input from the operation portion 54 when the lever 67 of the operation portion 54 is operated. The second rotation portion 75 outputs (transmits), to the opening/closing portion 53, the operation driving force transmitted from the first rotation portion 74. The first rotation portion 74 is configured to rotate upon receiving the operation driving force. The second rotation portion 75 is configured to rotate in conjunction with the first rotation portion 74.

The first rotation portion 74 is disposed at the lower end of the first groove 45A of the container guide 45, and is rotatably supported by the support plate 43. On the other hand, the second rotation portion 75 is disposed at the lower end of the second groove 45B, and is rotatably supported by the support plate 43.

As shown in FIG. 14, the first rotation portion 74 includes a first gear 74A. The second rotation portion 75 includes a second gear 75A that meshes with the first gear 74A. The first gear 74A is integrally formed with the first rotation portion 74, and the second gear 75A is integrally formed with the second rotation portion 75. As a result, when the first rotation portion 74 rotates in the state where the first gear 74A and the second gear 75A mesh with each other, the second rotation portion 75 rotates reversely with respect to the rotational direction of the first rotation portion 74. As shown in FIG. 14, the first gear 74A and the second gear 75A are disposed on the right side surface 43B of the support plate 43 that is opposite to the left side surface 43A on which the container guides 45 are formed.

The first gear 74A and the second gear 75A are set such that the rotation angle of the second rotation portion 75 is larger than the rotation angle of the first rotation portion 74. For example, the gears are set such that, when the first rotation portion 74 rotates 45 degrees together with the lever 67, the second rotation portion 75 rotates 90 degrees.

As shown in FIG. 14, the support plate 43 is provided with a spring 77. The spring 77 is a biasing member that biases the first rotation portion 74 counterclockwise in FIG. 14. The spring 77 is, for example, a torsion coil spring. With the presence of the spring 77, the second rotation portion 75 is biased clockwise in FIG. 14 by the spring 77 via the first gear 74A and the second gear 75A.

Figure 8:
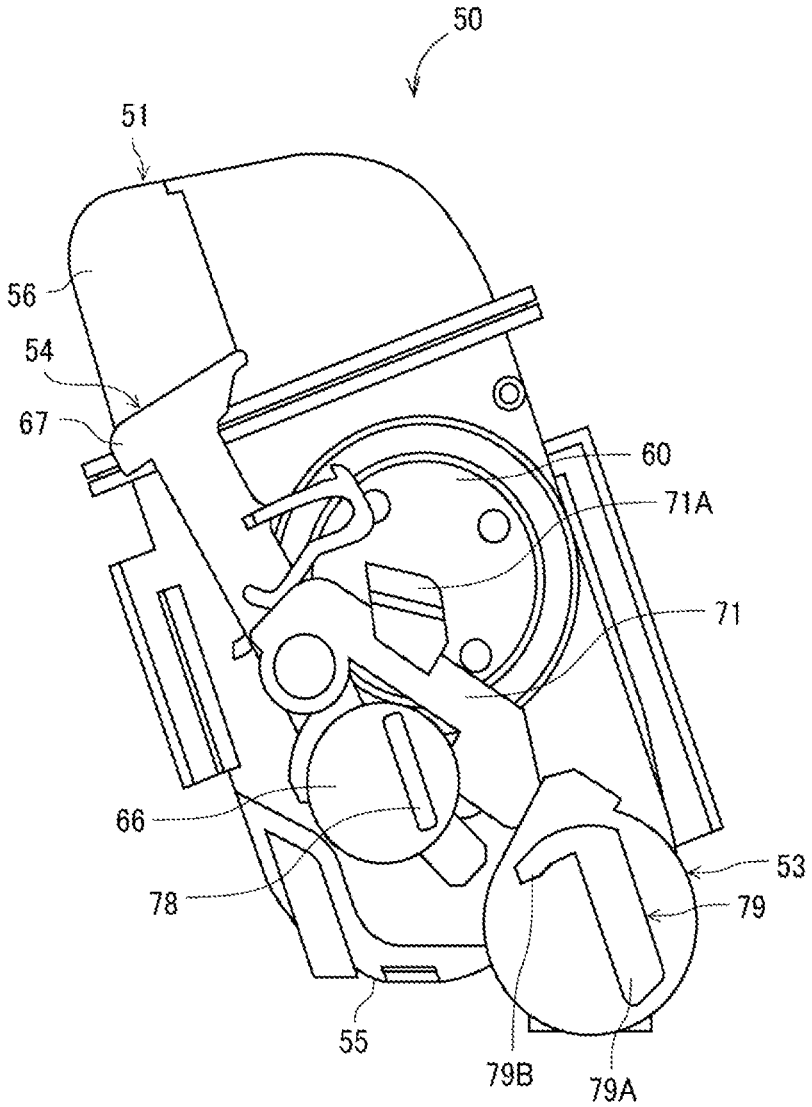
FIG. 8 is a side view showing the configuration of the side surface of the toner container, wherein the cover member is removed to expose the inside.

As shown in FIGS. 5 and 8, the operation portion 54 of the toner container 50 includes a first coupling portion 78 that is rotated when the operation portion 54 is operated. The first coupling portion 78 is integrally formed with the right end of the shaft 66. The first coupling portion 78 is formed like a plate that projects rightward from the right end of the shaft 66. The first coupling portion 78 extends in the attachment direction (namely, diagonally downward) in which the cover member 72 is guided by the container guide 45 when the housing 51 is attached to the support plate 43. When the toner container 50 is attached to the container guide 45 of the support plate 43, the first coupling portion 78 is coupled with the first rotation portion 74 of the drive transmission portion 76. That is, the first coupling portion 78 is coupled with the first rotation portion 74 in the state where the toner container 50 is attached. With this configuration, the operation driving force that is input when the operation portion 54 is operated is transmitted to the first rotation portion 74.

As shown in FIG. 13, the first rotation portion 74 of the drive transmission portion 76 has a first coupling groove 74B that is configured to be coupled with the first coupling portion 78 of the toner container 50. The first coupling groove 74B extends straight at least in part. On the other hand, the first coupling portion 78 is formed in such a shape as to be fitted in the first coupling groove 74B. That is, the groove width of the first coupling groove 74B is approximately the same as the thickness of the first coupling portion 78. When the housing 51 is attached to the apparatus main body 28, the first coupling portion 78 is inserted into the first coupling groove 74B, and is coupled therewith so as to be integrally rotatable with the first rotation portion 74.

As shown in FIGS. 5 and 8, the opening/closing portion 53 of the toner container 50 includes the second coupling portion 79 that integrally rotates with the shutter cylinder 61. The second coupling portion 79 is integrally formed with the right end of the cylinder 61. The second coupling portion 79 projects rightward from the right end of the cylinder 61. The second coupling portion 79 is formed in a shape of a hook in a cross section taken along a line that is perpendicular to the axis direction of the cylinder 61. The second coupling portion 79 receives the operation driving force from the second rotation portion 75 of the drive transmission portion 76. When the toner container 50 is attached to the container guide 45 of the support plate 43, the second coupling portion 79 is coupled with the second rotation portion 75 of the drive transmission portion 76. That is, the second coupling portion 79 is coupled with the second rotation portion 75 in the state where the toner container 50 is attached. This enables the operation driving force to be transmitted to the second coupling portion 79 via the first rotation portion 74 and the second rotation portion 75.

The second coupling portion 79 includes a first portion 79A and a second portion 79B, these creating the shape of a hook. The first portion 79A extends in the attachment direction (namely, diagonally downward) in which the cover member 72 is guided by the container guide 45 when the housing 51 is attached to the support plate 43. The second portion 79B extends in one of the rotational directions of the cylinder 61 from the upper end of the first portion 79A. The first portion 79A is larger in thickness than the first coupling portion 78.

As shown in FIG. 13, a second coupling groove 75B is formed on the second rotation portion 75 of the drive transmission portion 76, wherein the second coupling groove 75B is configured to be coupled with the second coupling portion 79 of the toner container 50. The second coupling groove 75B extends straight at least in part. On the other hand, the second coupling portion 79 (see FIGS. 5 and 8) is formed in such a shape as to be fitted in the second coupling groove 75B. That is, the groove width of the second coupling groove 75B is approximately the same as the thickness of the first portion 79A of the second coupling portion 79. As a result, the second coupling groove 75B and the first coupling groove 74B are different in groove width. When the housing 51 is attached to the support plate 43, the second coupling portion 79 is inserted into the second coupling groove 75B, and is coupled therewith so as to be integrally rotatable with the second rotation portion 75. The opening/closing portion 53 is configured such that the second coupling portion 79 and the second rotation portion 75 integrally rotate with each other, thereby the cylinder 61 is rotated in such a way as to open and close the toner discharge outlet 52.

The first coupling portion 78 and the second coupling portion 79 may be formed in a non-compatible shape which allows for attachment of the housing 51 to the apparatus main body 28 in a predetermined model, while not allowing for attachment of the housing 51 to the apparatus main body 28 in the other models. For example, depending on the model or the like of the image forming apparatus 10, the first coupling portion 78, the second coupling portion 79, the first coupling groove 74B of the first rotation portion 74, and the second coupling groove 75B of the second rotation portion 75 may be provided at different positions, with different shapes, or the like.

As shown in FIG. 14, the second rotation portion 75 includes an arm 75C (engaged portion). The arm 75C is a portion that is configured to abut on and be engaged with an engaging portion 81A of a detected bar 81 that are described below, and is also configured to be separated from the engaging portion 81A. The arm 75C is provided on the same side as the second gear 75A on the support plate 43. The arm 75C extends in one of the rotational directions of the second rotation portion 75. The arm 75C is integrally formed with the second rotation portion 75. In addition, the arm 75C has an outer circumference in the shape of a circular arc.

As shown in FIGS. 11 and 12, the apparatus main body 28 is provided with a detection portion 80. The detection portion 80 is configured to detect whether the toner discharge outlet 52 of the toner container 50 is opened or closed. In the present embodiment, the detection portion 80 detects the opening/closing state of all of the toner discharge outlets 52. Specifically, the detection portion 80 detects, with respect to a plurality of toner containers 50 attached to the support plate 43, whether or not all of the toner discharge outlets 52 are opened. The detection portion 80 is disposed below the four drive transmission portions 76.

The detection portion 80 includes the detected bar 81 (detected member) and a sensor 82 (sensor). The detected bar 81 is disposed below the four drive transmission portions 76 in such a way as to extend along the surface of the support plate 43 in an alignment direction of the four drive transmission portions 76 (front-rear direction 7). The sensor 82 is, for example, a transmission type optical sensor such as a photo-interruptor. The sensor 82 is disposed at one of opposite ends (the front end) of the detected bar 81, and detects the position of the detected bar 81 by detecting the position of the front end of the detected bar 81.

Below the four drive transmission portions 76, the detected bar 81 is supported by the right side surface 43B of the support plate 43 so as to be able to move in the front-rear direction 7. In the present embodiment, the detected bar 81 can be moved between positions that correspond to the opening position and closing position of the shutter cylinder 61. Specifically, the detected bar 81 is supported such that it can be displaced (moved) between a first position and a second position, wherein the first position (the position shown in FIG. 12) corresponds to the opening position of the shutter cylinder 61, and the second position (the position shown in FIG. 11) corresponds to the closing position of the shutter cylinder 61. Here, when the detected bar 81 is at the first position, it is detected that the front end of the detected bar 81 has receded from the optical path of the sensor 82, and the front end of the detected bar 81 is not interrupting the optical path; and when the detected bar 81 is at the second position, it is detected that the front end of the detected bar 81 has entered the optical path of the sensor 82, and the front end of the detected bar 81 is interrupting the optical path.

The other end (the rear end) of the detected bar 81 is connected to a tension spring 83 (elastic member). The tension spring 83 is attached to the support plate 43. The detected bar 81 is pulled rearward by the tension spring 83. That is, the tension spring 83 elastically biases the detected bar 81 toward the first position.

Figure 20:
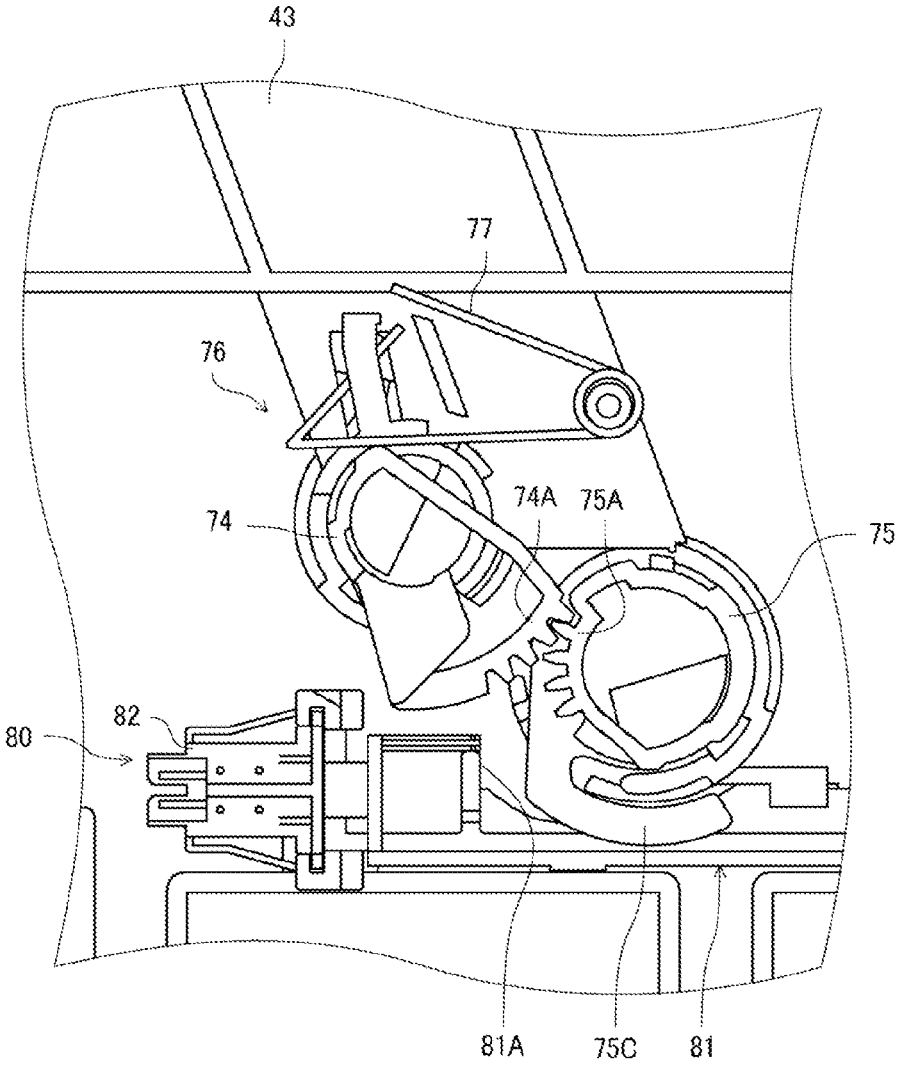
FIG. 20 is an enlarged view of the drive transmission portion, with the lever swung.

The detected bar 81 includes engaging portions 81A that are configured to be engaged with the arms 75C of the second rotation portions 75. Four engaging portions 81A are provided respectively in correspondence with the four arms 75C. As shown in FIG. 14, when the toner discharge outlet 52 is closed, the engaging portion 81A is engaged with the arm 75C. This allows the detected bar 81 to be pressed by the engaging portion 81A toward the second position resisting against the elastic biasing force of the tension spring 83, and the detected bar 81 is held at the second position. That is, when pressed by the engaging portions 81A, the detected bar 81 is restricted from moving from the second position to the first position (toward the tension spring 83). On the other hand, when the shutter cylinder 61 is rotated to the opening position and the toner discharge outlet 52 is opened as shown in FIG. 20, the second rotation portion 75 is rotated counter-clockwise, and the engaging portion 81A stops being engaged with the outer circumference of the arm 75C.

When all of the toner discharge outlets 52 are opened as shown in FIG. 12, all of the engaging portions 81A stop being engaged with the outer circumferences of the arms 75C. That is, engagements of all the engaging portions 81A are released. At this time, the detected bar 81 is pulled rearward by the elastic biasing force of the tension spring 83, and the front end of the detected bar 81 is moved rearward away from the sensor 82 and is moved to the first position (the position shown in FIG. 12).

With the above-described configuration of the detection portion 80, as shown in FIG. 11, when the detected bar 81 moves to the second position and the front end of the detected bar 81 interrupts the optical path, the sensor 82 detects the state where at least one shutter cylinder 61 is at the closing position, namely the state where at least one toner discharge outlet 52 is closed. On the other hand, as shown in FIG. 12, when the detected bar 81 moves to the first position and the front end of the detected bar 81 has receded from the optical path, the sensor 82 detects the state where all of the shutter cylinders 61 are at the opening position, namely the state where all of the toner discharge outlets 52 are opened.

Next, description is given of the attachment/detachment operation of the toner container 50 to the apparatus main body 28.

Before the toner container 50 is attached to the apparatus main body 28, the toner discharge outlet 52 is closed by the cylinder 61, and as shown in FIGS. 8 and 9, the operation portion 54 and the opening/closing portion 53 are in the lock state by the lock member 71. At this time, the first coupling portion 78 and the first portion 79A of the second coupling portion 79 extend in the attachment direction (namely, diagonally downward) in which the cover member 72 is guided by the container guide 45.

Furthermore, as shown in FIGS. 13 and 14, before the toner container 50 is attached to the apparatus main body 28, the first coupling groove 74B and the second coupling groove 75B of the first rotation portion 74 and the second rotation portion 75 of the drive transmission portion 76 are extending in the extension direction of the container guide 45 (namely, the attachment direction in which the cover 72 is guided).

When the toner container 50 is attached to the support plate 43, the cover member 72 is inserted into the container guide 45 of the support plate 43. This allows the cover member 72 to be guided diagonally downward by the container guide 45. Furthermore, as shown in FIGS. 15 and 16, the first coupling portion 78 of the toner container 50 is guided by the first groove 45A, and the second coupling portion 79 is guided by the second groove 45B. Subsequently, the first coupling portion 78 is coupled with the first coupling groove 74B of the first rotation portion 74, and the second coupling portion 79 is coupled with the second coupling groove 75B of the second rotation portion 75.

In addition, as shown in FIGS. 16 and 17, while the cover member 72 is guided by the container guide 45, the upper end of the projection 46 abuts on the claw 71A of the lock member 71 and pushes up the lock member 71. As a result, in the state where the first coupling portion 78 is coupled with the first rotation portion 74 and the second coupling portion 79 is coupled with the second rotation portion 75, the operation portion 54 and the opening/closing portion 53 of the toner container 50 are released from the lock state.

Figure 18:
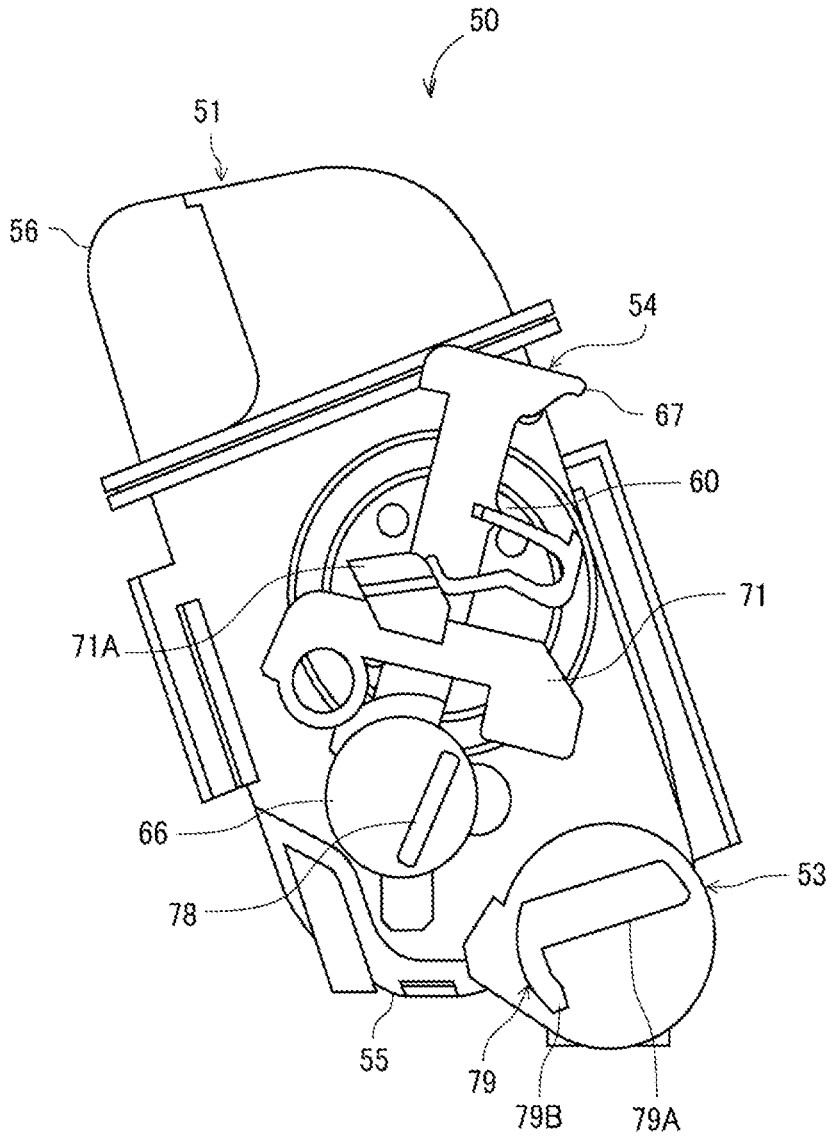
FIG. 18 is a side view of the toner container, with the lever of the operation portion swung.
Figure 19:
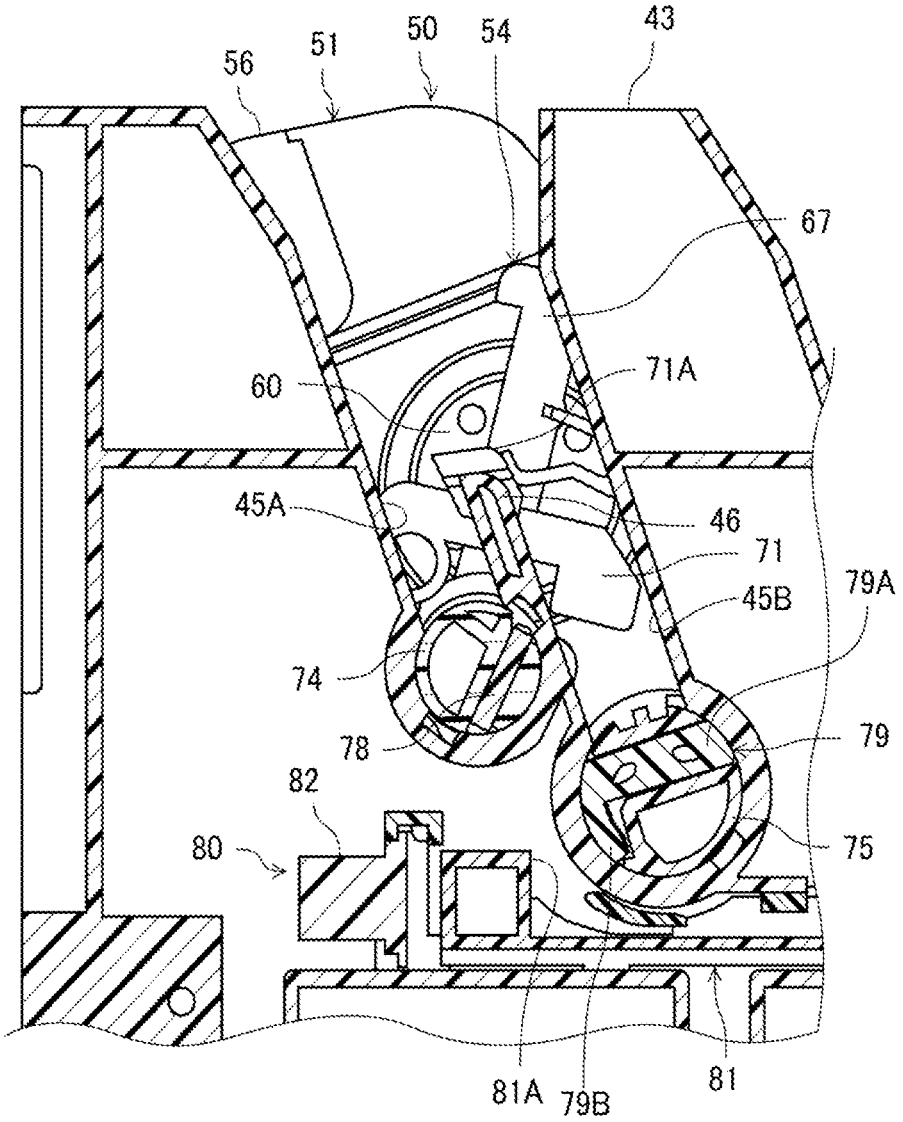
FIG. 19 is a partially broken view of the toner container attached to the support plate, with the lever swung.

Subsequently, the lever 67 of the operation portion 54 is swung so as to open the toner discharge outlet 52. Here, FIGS. 18 through 20 show the states where the lever 67 is swung.

When the lever 67 is swung in the state where the toner container 50 is attached to the support plate 43, the operation driving force is input to the first coupling portion 78 via the shaft 66 of the operation portion 54. This allows the shaft 66 and the first coupling portion 78 to be integrally rotated with the lever 67 clockwise, as shown in FIGS. 16 through 19. That is, the first coupling portion 78 is rotated by the same angle as the swing angle of the lever 67.

Here, since the first coupling portion 78 is coupled with the first rotation portion 74 of the drive transmission portion 76, the first coupling portion 78 is integrally rotated with the first rotation portion 74. On the apparatus main body 28 side, as shown in FIGS. 14 and 20, the first gear 74A of the first rotation portion 74 meshes with the second gear 75A of the second rotation portion 75. Thus, receiving the operation driving force transmitted from the first rotation portion 74, the second rotation portion 75 is rotated in the reverse direction to the rotation direction of the first rotation portion 74.

Here, since the second rotation portion 75 is coupled with the second coupling portion 79 of the toner container 50, the second coupling portion 79 is integrally rotated with the second rotation portion 75. With the rotation of the second coupling portion 79, the shutter cylinder 61 is integrally rotated with the second coupling portion 79. At this time, the shutter cylinder 61 is rotated from the closing position to the opening position. When all of the second rotation portions 75 are rotated, the detected bar 81 of the detection portion 80 moves from the second position to the first position.

As described above, swingingly operating the lever 67 in the state where the toner container 50 is attached to the apparatus main body 28 causes the shutter cylinder 61 to rotate in such a way as to open the toner discharge outlet 52. When all of the toner discharge outlets 52 are opened, the detected bar 81 moves from the second position to the first position, and the detection portion 80 detects that all of the toner discharge outlets 52 are opened.

As a result, according to the present embodiment, with the configuration where the rotational driving force of the lever 67 of the toner container 50 is transmitted to the opening/closing portion 53 of the toner discharge outlet 52 via the drive transmission portion 76 provided on the apparatus main body 28 side of the image forming apparatus 10, even if the user erroneously operates the lever 67 before the housing 51 is attached to the apparatus main body 28, the operation driving force is not transmitted to the opening/closing portion 53, and the toner discharge outlet 52 is not opened. It is thus possible to prevent toner leakage from the housing 51.

Meanwhile, according to the above-described configuration in which the toner discharge outlet 52 of the toner container 50 is opened or closed by manually oprating the lever 67 of the operation portion 54, it is necessary to detect whether or not the operation position of the lever 67 has reached the opening position which allows the toner discharge outlet 52 to be opened. If an image is formed in the state where the operation position of the lever 67 has not reached the opening position, the image is degraded due to insufficient supply of toner. A conventional mechanism for detecting the operation position of the lever 67 is configured such that the lever 67 interferes with the top cover 33 if the operation position of the lever 67 has not reached the opening position, and due to the interference, the top cover 33 cannot be closed. This configuration is provided with an intention to let the user know, from the fact that the top cover 33 cannot be closed, that the lever 67 is inappropriately positioned.

However, according to the configuration allowing the lever 67 of the operation portion 54 to interfere with the top cover 33, either the top cover 33 or the lever 67 might be damaged due to the impact caused by the contact of the lever 67 with the closed top cover 33. The present embodiment makes it possible to detect the opening/closing state of the toner discharge outlet 52 without causing such a problem.

According to the present embodiment, in the state where all of the toner containers 50 are attached to the apparatus main body 28, when not all of the levers 67 are not swingingly operated, namely when some of the levers 67 are no swingingly operated, or when the levers 67 are swingingly operated insufficiently, the detected bar 81 of the detection portion 80 stays at the second position, without moving to the first position. As a result, the detection portion 80 detects that at least one toner discharge outlet 52 is closed, by detecting that the front end of the detected bar 81 is interrupting the optical path. Specifically, an electric signal indicating that the front end of the detected bar 81 is interrupting the optical path is sent from the sensor 82 of the detection portion 80 to a control portion (not shown), and the control portion determines that at least one toner discharge outlet 52 is closed. With this configuration, it is possible to detect that at least one toner discharge outlet 52 is not opened when the opening/closing state of the toner discharge outlet 52 is as such. In this way, it is possible to detect the opening/closing state of the toner discharge outlet 52 regardless of the opening/closing position of the top cover 33. This makes it possible to detect the opening/closing state of the toner discharge outlet 52 without damaging the lever 67 of the operation portion 54.

On the other hand, in the state where all of the toner containers 50 are attached to the apparatus main body 28, when all of the levers 67 are swingingly operated, the detected bar 81 of the detection portion 80 moves to the first position. As a result, the detection portion 80 detects that all of the toner discharge outlets 52 are opened, by detecting that the front end of the detected bar 81 has receded from the optical path. Specifically, an electric signal indicating that the front end of the detected bar 81 has receded from the optical path is sent from the sensor 82 of the detection portion 80 to the control portion (not shown), and the control portion determines that all of the toner discharge outlets 52 are opened.

In addition, since the lock member 71 that makes the operation portion 54 and the opening/closing portion 53 to the lock state is provided, the operation portion 54 and the opening/closing portion 53 are in the lock state by the lock member 71 before the toner container 50 is attached to the apparatus main body 28. This makes it possible to prevent the operation portion 54 from being operated erroneously and prevent the opening/closing portion 53 from being activated to open or close the toner discharge outlet 52. Furthermore, with the configuration where the lock state of the operation portion 54 and the opening/closing portion 53 is released in conjunction with the attachment operation of the toner container 50 to the apparatus main body 28, an operation for releasing the lock state becomes unnecessary.

The present embodiment describes an example case where each drive transmission portion 76 includes the first gear 74A and the second gear 75A. However, not limited to this configuration, for example, each drive transmission portion 76 may include a transmission belt that is wound around the first rotation portion 74 and the second rotation portion 75.

The present embodiment describes an example case where the present disclosure is applied to the image forming apparatus 10 that includes four toner containers 50. However, not limited to this, the present disclosure is applicable to an image forming apparatus that includes one toner container 50.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body; and a toner case configured to be attached to the apparatus main body, wherein the toner case includes:

a housing configured to store toner;

a toner discharge outlet formed in the housing;

an opening/closing portion provided in the housing and configured to open and close the toner discharge outlet; and an operation portion provided in the housing, the apparatus main body includes:

a drive transmission portion including: an input portion configured to receive a driving force input from the operation portion; and an output portion configured to output, to the opening/closing portion, the driving force transmitted from the input portion; and a detection portion configured to detect an opening/closing state of the toner discharge outlet, the operation portion includes a first coupling portion configured to be coupled with the input portion of the drive transmission portion in a state where the toner case is attached to the apparatus main body, and transmit the driving force to the input portion, the opening/closing portion includes:

a second coupling portion configured to be coupled with the output portion of the drive transmission portion in the state where the toner case is attached to the apparatus main body, and receive the driving force from the output portion; and a displacement member configured to be displaced, by the driving force transmitted to the second coupling portion, between an opening position for opening the toner discharge outlet and a closing position for closing the toner discharge outlet, and the detection portion includes:

a detected member configured to be moved upon receiving the driving force from the output portion of the drive transmission portion and displaced between a first position corresponding to the opening position of the displacement member and a second position corresponding to the closing position of the displacement member; and a sensor configured to detect at what position the detected member is.

2. The image forming apparatus according to claim 1, wherein a plurality of toner cases can be attached to the apparatus main body, and the detected member is positioned at the second position when at least one of displacement members of the plurality of toner cases is at the closing position, and is positioned at the first position when all of the displacement members are at the opening position.

3. The image forming apparatus according to claim 1, wherein upon receiving the driving force transmitted from the input portion, the output portion moves the detected member toward the first position.

4. The image forming apparatus according to claim 1 further comprising:

an elastic member configured to bias the detected member toward the first position;

an engaging portion provided in the detected member; and an engaged portion provided in the output portion and configured to be engaged with the engaging portion, wherein upon receiving from the input portion the driving force that moves the displacement member to the opening position, the output portion allows the engaged portion to be engaged with the engaging portion in such a way as to move the detected member toward the second position resisting against a biasing force of the elastic member, and upon receiving from the input portion the driving force that moves the displacement member to the closing position, the output portion releases the engagement of the engaged portion with the engaging portion, thereby allowing the detected member to be moved from the second position to the first position by the biasing force of the elastic member, and the sensor detects that the detected member has moved to the first position.

5. The image forming apparatus according to claim 4, wherein the input portion includes a first rotation portion configured to rotate upon receiving the driving force, the output portion includes a second rotation portion configured to rotate in conjunction with the first rotation portion, and the engaged portion is provided in the second rotation portion.

6. The image forming apparatus according to claim 5, wherein the second rotation portion includes the engaged portion, and the engaged portion is coupled with the detected member and presses the detected member to the second position when the driving force is not input, and is separated from the detected member when the driving force is input.

7. The image forming apparatus according to claim 4, wherein a plurality of toner cases can be attached to the apparatus main body, a plurality of drive transmission portions are provided repectively in correspondence with the plurality of toner cases, the detected member has an elongated shape and extends in an alignment direction of the plurality of drive transmission portions, a plurality of engaged portions are respectively provided in output portions of the plurality of drive transmission portions, and a plurality of engaging portions are provided in the detected member at positions that respectively correspond to the plurality of engaged portions, and the plurality of engaging portions can be engaged with corresponding engaged portions of the plurality of engaged portions.

* * * * *